US009834742B2

(12) United States Patent
Larson, III et al.

(10) Patent No.: US 9,834,742 B2
(45) **Date of Patent: *Dec. 5, 2017**

(54) CITRATE SALT BATHROOM CLEANERS

(71) Applicant: Ecolab USA Inc., St. Paul, MN (US)

(72) Inventors: Dale Curtis Larson, III, Eagan, MN (US); Mark Dennis Levitt, West St. Paul, MN (US)

(73) Assignee: ECOLAB USA INC., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,229

(22) Filed: Nov. 22, 2016

(65) Prior Publication Data

US 2017/0073617 A1 Mar. 16, 2017

Related U.S. Application Data

(63) Continuation of application No. 13/721,318, filed on Dec. 20, 2012, now Pat. No. 9,534,190.

(51) Int. Cl.

| | |
|---|---|
| ***C11D 1/00*** | (2006.01) |
| ***C11D 1/04*** | (2006.01) |
| ***C11D 3/04*** | (2006.01) |
| ***C11D 3/30*** | (2006.01) |
| ***C11D 3/20*** | (2006.01) |

(Continued)

(52) U.S. Cl.

CPC ..... *C11D 3/2086* (2013.01); *B08B 3/08* (2013.01); *C11D 1/04* (2013.01); *C11D 1/662* (2013.01); *C11D 1/72* (2013.01); *C11D 1/90* (2013.01); *C11D 3/042* (2013.01); *C11D 3/044* (2013.01); *C11D 3/046* (2013.01); *C11D 3/30* (2013.01); *C11D 11/0023* (2013.01)

(58) Field of Classification Search

CPC .. C11D 1/72; C11D 1/662; C11D 1/90; C11D 3/042; C11D 3/044; C11D 3/046; B08B 3/04

USPC ..... 510/238, 245, 421, 426, 434, 435, 477, 510/488, 499; 134/38, 41, 42

See application file for complete search history.

(56) References Cited

U.S. PATENT DOCUMENTS

| | | | |
|---|---|---|---|
| 3,915,633 | A | 10/1975 | Ramachandran |
| 3,969,258 | A | 7/1976 | Carandang et al. |

(Continued)

FOREIGN PATENT DOCUMENTS

| | | | |
|---|---|---|---|
| GB | 2306499 | A | 7/1997 |
| GB | 2319179 | A | 5/1998 |

(Continued)

OTHER PUBLICATIONS

Ecolab USA Inc., PCT/US2013/077004, "The International Search Report and the Written opinion of the International Searching Authority, or the Declaration", dated Apr. 21, 2014.

*Primary Examiner* — Gregory R Delcotto

(74) *Attorney, Agent, or Firm* — McKee, Voorhees & Sease, PLC

(57) ABSTRACT

A hard surface cleaning composition, namely a bathroom cleaning composition, using partially neutralized citric acid salts and/or fully neutralized ethanolamine citrate salts are disclosed. The cleaning composition is unexpectedly safe to use, environmentally-friendly and efficacious for removal of soap scum and water hardness stains at mildly acidic and/or alkaline pHs. Methods of using the same are disclosed.

17 Claims, 4 Drawing Sheets

(51) Int. Cl.

| | |
|---|---|
| ***C11D 1/90*** | (2006.01) |
| ***C11D 1/72*** | (2006.01) |
| ***C11D 1/66*** | (2006.01) |
| ***B08B 3/08*** | (2006.01) |
| ***C11D 11/00*** | (2006.01) |

(56) References Cited

U.S. PATENT DOCUMENTS

| | | | | |
|---|---|---|---|---|
| 4,859,359 | A | 8/1989 | DeMatteo et al. | |
| 5,039,441 | A | 8/1991 | Thomas et al. | |
| 5,122,541 | A | 6/1992 | Eggensperger et al. | |
| 6,046,148 | A | 4/2000 | Toussaint et al. | |
| 6,156,129 | A | 12/2000 | Hlivka et al. | |
| 6,221,823 | B1 | 4/2001 | Crisanti et al. | |
| 6,346,508 | B1 | 2/2002 | Leonard et al. | |
| 6,432,395 | B1 | 8/2002 | Rochon et al. | |
| 6,699,825 | B2 | 3/2004 | Rees et al. | |
| 6,936,579 | B2 | 8/2005 | Urban | |
| 7,199,094 | B2 | 4/2007 | Cheung et al. | |
| 7,414,016 | B1 | 8/2008 | Van Buskirk et al. | |
| 7,696,143 | B2 | 4/2010 | McCue et al. | |
| 7,829,513 | B2 | 11/2010 | McCarthy et al. | |
| 8,268,334 | B2 | 9/2012 | Dreilinger et al. | |
| 9,534,190 | B2 * | 1/2017 | Larson, III ..... | C11D 3/2086 |
| 2002/0169088 | A1 | 11/2002 | Wang | |
| 2007/0105744 | A1 | 5/2007 | Amiconi | |
| 2008/0227682 | A1 | 9/2008 | Chi-Cheng Feng et al. | |
| 2009/0312225 | A1 | 12/2009 | Szewczyk et al. | |
| 2011/0009309 | A1 | 1/2011 | Mertens | |
| 2011/0146707 | A1 | 6/2011 | Cermenati et al. | |
| 2011/0146725 | A1 | 6/2011 | Woo | |
| 2011/0160116 | A1 | 6/2011 | Mckechnie et al. | |
| 2011/0226293 | A1 | 9/2011 | Bonnechere et al. | |
| 2011/0230380 | A1 | 9/2011 | Holzhauer et al. | |
| 2011/0278194 | A1 | 11/2011 | Zhu | |
| 2012/0012495 | A1 | 1/2012 | Morrison | |
| 2012/0102668 | A1 | 5/2012 | De Leersnyder | |
| 2012/0122757 | A1 | 5/2012 | Gaudreault | |
| 2012/0156377 | A1 | 6/2012 | Veith | |
| 2012/0213759 | A1 | 8/2012 | Karsten | |
| 2012/0258903 | A1 | 10/2012 | Bjelopavlic | |
| 2013/0072419 | A1 | 3/2013 | Blattner | |
| 2013/0196893 | A1 | 8/2013 | Busby | |
| 2013/0345110 | A1 | 12/2013 | Volont | |

FOREIGN PATENT DOCUMENTS

| | | | |
|---|---|---|---|
| GB | 2329901 | A | 4/1999 |
| WO | WO9715649 | A1 | 5/1997 |
| WO | WO9719158 | A1 | 5/1997 |
| WO | WO9743369 | A1 | 11/1997 |
| WO | WO9961569 | A1 | 12/1999 |
| WO | WO2008046449 | A1 | 4/2008 |

* cited by examiner

CITRATE SALT BATHROOM CLEANERS

CROSS-REFERENCE TO RELATED APPLICATIONS

This application is a Continuation of U.S. Ser. No. 13/721,318 filed Dec. 20, 2012, now U.S. Pat. No. 9,534,190, herein incorporated by reference in its entirety.

FIELD OF THE INVENTION

The present invention relates to acidic and/or alkaline bathroom and/or hard surface cleaners providing improved cleaning over citric acid cleaners. In particular, a highly effective, safe to use, environmentally-friendly bathroom cleaner including partially neutralized citric acid salts is disclosed. Methods of use are further disclosed for bathroom and/or other hard surface cleaning.

BACKGROUND OF THE INVENTION

Citric acid and sodium citrate are commonly used bathroom cleaners. Many cleaning compositions use citric acid, below a pH of 3, in order to achieve cleaning performance on various hard surfaces. In addition, sodium citrate is commonly used at a pH near 7, however the neutral citrate salt does not provide as superior cleaning efficacy as that achieved by the acidic citric acid compositions. The increase in pH of the citrate salt decreases the cleaning power of the compositions, such that the majority of hard surface and/or bathroom cleaners employing citric acid and/or its salt prefer lower pH ranges, particularly pH less than 3. See e.g. U.S. Pat. Nos. 6,221,823, 6,936,579, 7,199,094, 7,696,143 and 8,268,334, which are herein incorporated by reference in their entirety.

Citric acid and/or compositions having a pH below about 3 are particularly well suited for cleaning soap scum, scale (i.e. hard water stains and lime scale as may also be used to refer to such stains commonly found in bathrooms) and/or other residues as is commonly found in bathrooms due to is triprotic acid strength when formulated at pH values less than about 3. The removal of soap scum and scale requires the strength of an acid to effectively clean due to the presence of calcium and magnesium salts and soap residues. Similarly, the acid component is needed to treat hard water stains, which are mineral stains caused by the deposition of salts, such as calcium or magnesium carbonates, frequently present in hard water. Still further, the strength of acidic products are further needed for removing soap scum stains, which include the residues of fatty acid soaps which are often based on alkaline salts of low fatty acids known to precipitate in hard water due to the presence of metal salts therein leaving an undesirable residue upon such surfaces.

It is known in the art that highly acidic cleaning agents such as strong acids effectively remove hard water stains. However, there are numerous toxicological concerns as well as environmental concerns associated with such cleaning compositions. Other compositions known to effectively remove soap scum use high concentrations of organic and/or inorganic acids along with detergents. However, these compositions may have limited efficacy against other types of stains often found on hard surfaces, namely in bathrooms, and further have toxicological concerns.

Accordingly, it is an objective of the claimed invention to develop improved cleaning compositions having milder pH ranges than citric acid compositions below pH 3 while providing at least substantially similar cleaning efficacy, if not greater efficacy, than unneutralized citric acid.

In particular, it is an objective of the claimed invention to provide improved bathroom and hard surface cleaners having Green Seal approval for use as environmentally-friendly cleaning compositions.

A further object of the invention is to create moderately acidic and/or alkaline bathroom and/or hard surface cleaners providing highly effective soil removal capabilities through the chelation mechanism of the partially neutralized citric acid salts.

A further object of the invention is to provide highly effective, safe to use, cleaning compositions employing partially neutralized citric acid salts.

BRIEF SUMMARY OF THE INVENTION

The present invention provides moderately acidic and/or alkaline bathroom and/or hard surface cleaners providing highly effective soil removal capabilities. In particular, the compositions provide significant cleaning benefits with respect to removing soap scum stains and hard water stains through the use of compositions containing partially neutralized citric acid salts.

In one embodiment, the present invention is a cleaning composition comprising: from about 0.5 wt-% to about 65 wt-% of a partially neutralized citric acid salt, wherein said partially neutralized citric acid salt is between about 50-80% neutralized, and wherein said composition provides at least substantially-similar cleaning performance as citric acid and/or sodium citrate.

In an embodiment, the present invention is a composition comprising: from about 0.5 wt-% to about 65 wt-% of citric acid; and from about 1 wt-% to about 25 wt-% of an alkalinity source neutralizing agent, wherein said composition generates in-situ a partially neutralized citric acid salt having a degree of neutralization of between about 50% to about 80%.

In a still further embodiment, the present invention is a method for cleaning bathroom surfaces and/or other hard surfaces comprising: contacting a soiled surface for a period of time sufficient to remove hard water soils and/or soap scum stains with an aqueous composition comprising from about 0.5 wt-% to about 65 wt-% of a partially neutralized citric acid salt, wherein said partially neutralized citric acid salt has a degree of neutralization of between about 50-80%; and removing said soils from said surface.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
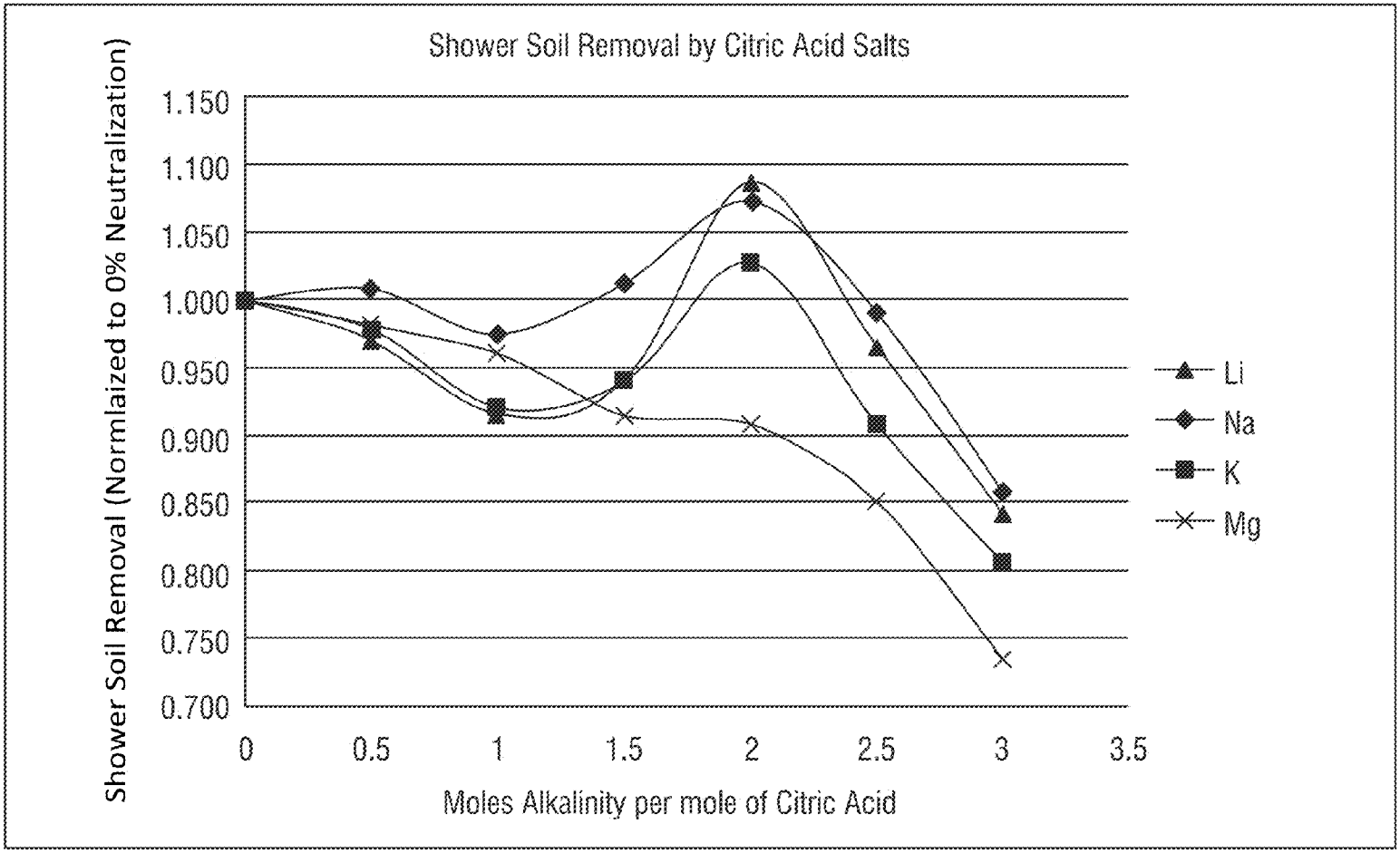
FIG. 1 shows a graph of soil removal using citric acid salts according to embodiments of the invention.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The embodiments of this invention are not limited to particular bathroom and/or hard surface cleaning compositions and methods of using the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claim1ng the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism. For the purpose of this patent application, successful microbial reduction is achieved when the microbial populations are reduced by at least about 50%, or by significantly more than is achieved by a wash with water. Larger reductions in microbial population provide greater levels of protection.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both. As used herein, the term "cleaning performance" may be measured in terms of percentage of soil removal. In an aspect of the invention, the cleaning compositions according to the invention provide at least substantially similar cleaning performance to conventional citric acid cleaning compositions having pHs less than about 3 and/or conventional sodium citrate (or other fully neutralized citrate salts) with milder pH ranges. Beneficially, in other aspects, the cleaning compositions according to the invention provide superior cleaning performance to these conventional citric acid and/or sodium citrate compositions.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

While an understanding of the mechanism is not necessary to practice the present invention and while the present invention is not limited to any particular mechanism of action, it is contemplated that, in some embodiments, the bathroom and/or hard surface cleaning compositions unexpectedly provide efficacious cleaning performance using partially neutralized citric acid salt compositions. In some aspects, the partially neutralized citric acid salts are generated in-situ from the formulation combining citric acid and a neutralizing alkalinity source as a neutralizing agent. In other aspects, the partially neutralized citric acid salts may be commercially-available and provided to a composition according to the invention, such as for example, dipotassium citrate and/or diammonium citrate, which are approximately 67% neutralized and suitable for use as a soap scum-removing active according to the invention. In still further aspects, the partially neutralized citric acid salts may be generated from a fully neutralized citrate salt (e.g. dipotassium citrate or others) and combined with citric acid to obtain the partially neutralized citric acid salt for use according to the invention.

Despite having an increased pH (e.g. above 3) in comparison to conventional citric acid cleaning compositions there is no decline in cleaning efficacy, such as that which is seen with sodium citrate compositions having pH up to about 7. Without being limited to a particular mechanism of action, it is recognized that citric acid contains 3 carboxylic acid groups, providing a wide range of partially neutralized states due to each acid group having a different $pK_a$. The compositions of the invention have unexpectedly identified a preferred certain neutralizing agents to provide approximately two-thirds neutralization state of the various carboxylic acid groups of citric acid and/or citrate salts. The various stages of neutralization are shown below, as each carboxylic acid group becomes neutralized sequentially to afford a fully neutralized citrate salt.

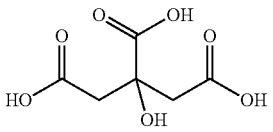

Citric acid (un-neutralized)

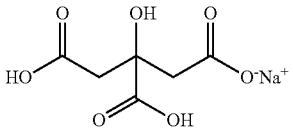

Monosodium Citrate (1/3 neutralized)

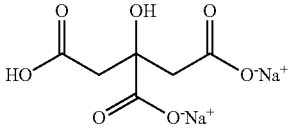

Disodium Citrate (2/3 neutralized)

-continued

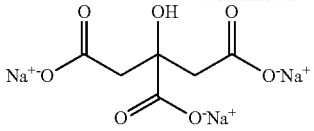

Trisodium Citrate (fully neutralized)

Cleaning Compositions

According to an embodiment of the invention the compositions comprise, consist of and/or consist essentially of a soap scum-removing active. In an aspect, the soap scum-removing active is a partially neutralized citric acid salt. In another aspect, the soap scum-removing active is a fully neutralized ethanolamine citrate salt. According to the invention the combination of citrate ions at particular degrees of neutralization beneficially produces cleaning performance better than that of un-neutralized or fully neutralized citric acid (e.g. sodium citrate).

According to an additional embodiment of the invention the compositions comprise, consist of and/or consist essentially of citric acid and a neutralizing agent. In some aspects the neutralizing agent is an alkalinity source, such as for example, ammonia, an ethanolamine and/or a monovalent hydroxide. In other embodiments of the invention the compositions comprise, consist of and/or consist essentially of citric acid and fully neutralized citric acid salt to adjust the pH and obtain a partially neutralized citric acid salt. In additional aspects of the invention, the various compositions may further comprise a surfactant. In additional aspects, the compositions may further comprise water. The compositions may optionally include additional functional ingredients.

The compositions according to the invention provided as a concentrated composition have a pH between about 4-7, preferably between about 4-6.5, and preferably between about 4-5. In a further aspect, the pH of the use solutions generated from the concentrated cleaning compositions is from about pH 4-7, preferably between about 5-7, more preferably between about 5-5.5. As recognized by the art, the correlation between pH and degree of neutralization is a constant relationship. The pH as a measure of acidity (using pKa) is directed correlated with the degree of neutralization of the particular acid. In particular, the ratio of neutralized to un-neutralized acid sites for each of the three carboxylic acid groups in citric acid can be calculated according to the Henderson-Hasselbalch equation. The absolute value of the neutralized and unneutralized acid groups of a citrate salt can be calculated at any given pH to determine the degree of neutralization as reported according to the compositions of the present invention.

The concentrated compositions and/or use dilutions of the concentrated compositions, and/or ready-to-use dilute concentration compositions according to the invention provide significant utility for use as both bathroom cleaners and hard surface cleaners. The liquid or aqueous compositions disclosed according to the invention are particularly suitable for use as a dilutable cleaning concentrate or as a ready-to-use product. According to the invention, a concentrate refers to a composition that is intended to be further diluted with water to provide a use solution. A use solution refers to an aqueous composition that can be applied directly to surfaces. In general, a use solution can have a solids content of less than about 90 wt-%, whereas the solids content refers to the weight percent of non-water components.

The compositions are dissolved in water to form a stable solution. Additional stabilizing agents may be employed to improve phase stability of the compositions as disclosed herein. The compositions according to the invention may be provided in various forms for providing cleaning compositions for use according to the methods of the invention. According the invention, the compositions are provided as a liquid. The compositions may be dispensed from single or multi-use packaging in the concentrated and/or ready-to-use product formulations.

Soap Scum-Removing Active

According to the invention the cleaning compositions include a soap scum-removing active. In an aspect of the invention, the soap scum-removing active is a partially neutralized salt of a weak acid. In an aspect of the invention, the soap scum-removing active is a citric acid salt that is partially neutralized. As referred to herein according to the invention, the soap scum-removing active may be referred to as a citric acid salt (having a particular degree of neutralization), a citrate salt, partially neutralized citric acid salt, or the like.

The terms of use referring to the partially neutralized citric acid salts according to the invention shall be further understood to refer to the soap scum-removing active that is either formed in-situ in the cleaning compositions according to the invention (e.g. upon formulation of the neutralizing agent with the weak acid (e.g. citric acid)) and/or provided or selected from a commercially-available source.

In a further aspect of the invention, the soap scum-removing active may be referred to as an ethanolamine citrate salt in the event an ethanolamine is provided as the neutralizing agent for a composition, in such embodiments the ethanolamine citrate salt may be either partially neutralized and/or fully neutralized. In a still further aspect of the invention, the soap scum-removing active may be a combination of different partially neutralized citric acid salts and/or a fully neutralized ethanolamine citrate salt.

Particularly suitable citric acid salts include sodium citrate, potassium citrate, lithium citrate, ammonium citrate, monoethanolamine citrate, diethanolamine citrate and/or triethanolamine citrate, which are created in-situ by partially, or fully neutralizing a citric acid source. In an additional embodiment, the in-situ generation of the partially neutralized particular citrate salt, a source of pre-made or commercially-available citrate salt can be combined with the in-situ generated partially neutralized citric acid salt. For example, without being limited to a particular embodiment of the invention, a cleaning composition may include an in-situ generated partially neutralized potassium citrate salt along with a commercially-available sodium citrate source for use as the soap scum-removing actives.

The degree of neutralization referred to herein for the various salts of weak acids, namely citric acid salts, is represented as a percentage of neutralization. Without being limited according to the compositions and/or methods of the invention in order to neutralize citric acid for use as the soap scum-removing active, 3 moles alkalinity would be needed to fully neutralize 1 mole of acid (i.e. citric acid has 3 carboxylic acid groups capable of being neutralized). Therefore, according to the exemplary preferred embodiments of the invention, to provide at least a 67% neutralized citrate salt as the soap scum-removing active, 2 moles of alkalinity (i.e. neutralizing agent) are provided per 1 mole of citric acid in order to neutralize the two carboxylic acid groups of the citric acid having lower pKa values.

In an aspect, the citric acid salt soap scum-removing active is referred to as at least a partially neutralized active. In an aspect, the citric acid salt soap scum-removing active is at least about 50% neutralized and preferably at least about 67% neutralized. In another aspect, the citric acid salt soap scum-removing active is more than about 67% neutralized. In another aspect, the citric acid salt soap scum-removing active is between about 56%-76% neutralized. In yet another aspect, the ethanolamine citrate salt soap scum-removing active is fully neutralized. Without being limited to a particular composition according to the embodiments of the invention, the percent neutralization in a concentrated cleaning composition is slightly greater than the percent neutralization in a diluted use solution of the cleaning composition In an aspect, the compositions include from about 0.1 wt-%-65 wt-% citric acid, from about 0.5 wt-%-65 wt-%, from about 1 wt-%-65 wt-% citric acid, from about 5 wt-%-65 wt-% citric acid, preferably from about 10 wt-%-50 wt-% citric acid. In addition, without being limited according to the invention, all ranges recited are inclusive of the numbers defining the range and include each integer within the defined range.

In another aspect, the compositions include from about 0.1 wt-%-65 wt-% partially neutralized citric acid salt, from about 0.5 wt-%-65 wt-%, from about 1 wt-%-65 wt-% partially neutralized citric acid salt, from about 5 wt-%-65 wt-% partially neutralized citric acid salt, preferably from about 10 wt-%-50 wt-% partially neutralized citric acid salt. In addition, without being limited according to the invention, all ranges recited are inclusive of the numbers defining the range and include each integer within the defined range.

In a still further aspect, the compositions include from about 0.1 wt-%-65 wt-% fully neutralized ethanolamine citrate salt, from about 0.5 wt-%-65 wt-%, from about 1 wt-%-65 wt-% fully neutralized ethanolamine citrate salt, from about 5 wt-%-65 wt-% fully neutralized ethanolamine citrate salt, preferably from about 10 wt-%-50 wt-% fully neutralized ethanolamine citrate salt. In addition, without being limited according to the invention, all ranges recited are inclusive of the numbers defining the range and include each integer within the defined range.

The soap scum-removing active is included in the compositions in an amount effective to provide detersive properties or soap scum and other hardness removal for effective bathroom and other hard surface cleaning. An effective amount should be considered as an amount that provides a concentrate of the cleaning composition the optional scum removal properties.

Neutralizing Agents

According to some embodiments of the invention the cleaning compositions may include a neutralizing agent. In an aspect of the invention, the neutralizing agent is an alkalinity source. In a preferred aspect the alkalinity source is a monovalent hydroxide. In a further preferred aspect, the monovalent hydroxide is an alkali metal hydroxide, such as sodium hydroxide, potassium hydroxide and/or lithium hydroxide. According to this aspect, the neutralizing agent forms a partially neutralized citric acid salt.

In an additional aspect the alkalinity source is an ethanolamine, such as monoethanolamine, diethanolamine and/or triethanolamine. According to this aspect, the neutralizing agent forms a partially neutralized ethanolamine citrate salt, and/or a fully neutralized ethanolamine citrate salt according to certain embodiments of the invention.

In a still further additional aspect of the invention, the alkalinity source is an ammonia source. According to this aspect, the neutralizing agent forms a partially neutralized ammonium citric acid salt. However, according to preferred aspects of the invention, the neutralizing agent is the substituted ammonium source (such as mono-, di- and/or triethanolamine).

In an aspect, the compositions include from about 0.1 wt-%-50 wt-% neutralizing agent, from about 0.1 wt-%-25 wt-% neutralizing agent, from about 1 wt-%-25 wt-% neutralizing agent, preferably from about 1 wt-%-20 wt-% neutralizing agent. The neutralizing agent is included in the compositions in an amount effective to provide the desired amount of neutralization of the soap scum-removing active. An effective amount should be considered as an amount that provides a concentrate of the cleaning composition the optional degree of neutralization of the soap scum-removing active. In addition, without being limited according to the invention, all ranges recited are inclusive of the numbers defining the range and include each integer within the defined range.

Surfactants

According to the invention the cleaning compositions may include a surfactant. In an aspect the surfactant may be any surfactant wetting a surface for the soap scum-removing active within the cleaning compositions. In an aspect, the compositions include from about 0 wt-%-50 wt-% surfactant, from about 1 wt-%-50 wt-% surfactant, from about 5 wt-%-50 wt-% surfactant, preferably from about 10 wt-%-30 wt-% surfactant. In addition, without being limited according to the invention, all ranges recited are inclusive of the numbers defining the range and include each integer within the defined range.

Particularly suitable surfactants for use in the bathroom and other hard surface cleaning compositions of the invention include, for example zwitterionic surfactants. In more preferred aspects, a betaine surfactant, such as cocoamido propyl betaine is preferred. An additional class of particularly suitable surfactants for use in the bathroom and other hard surface cleaning compositions of the invention include, for example nonionic surfactants. In more preferred aspects, a natural fatty alcohol based surfactant, such as an alkyl polyglycoside C8-C16, commercially available as Glucopon® 425 (BASF Company) is preferred. As set forth in this description of the invention, addition classes of surfactants may be employed, and are described below.

Alkyl Polyglycoside Nonionic Surfactants

According to the invention the cleaning compositions may include an alkyl polyglycoside surfactant. Suitable alkyl polyglycosides include but are not limited to alkyl polyglucosides and alkyl polypentosides. Alkyl polyglycosides are bio-based non-ionic surfactants which have wetting and detersive properties. Commercially available alkyl polyglycosides may contain a blend of carbon lengths. Suitable alkyl polyglycosides include alkyl polyglycosides containing short chain carbons, such as chain lengths of less than $C_{16}$. In one example, suitable alkyl polyglycosides include $C_8$-$C_{16}$ alkyl polyglycosides. Additional description of suitable alkyl polyglycosides are set forth, for example, in U.S. Pat. Nos. 8,287,659 and 8,299,009, and U.S. patent application Ser. Nos. 12/819,667, 12/884,638, 12/887,716, 13/597,380, 13/622,392, and 13/653,965, which which are herein incorporated by reference in their entirety.

Zwitterionic Surfactants

According to the invention the cleaning compositions may include a zwitterionic surfactant, such as a betaine surfactant. Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

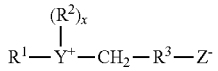

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

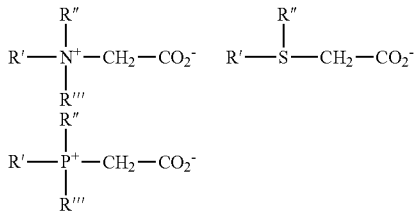

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2\ N^+\ R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references is herein incorporated by reference in their entirety.

Water

In some embodiments, the compositions of the present invention include a source of water, such as ready-to-use compositions. In other embodiments, the ultra-concentrated forms of the composition of the present invention do not include a source of water, and are diluted with a water source, such as for example at a site of use. The composition may include water provided as deionized water or as softened water. The water provided as part of the concentrate can be relatively free of hardness. It is expected that the water can be deionized to remove a portion of the dissolved solids. That is, the concentrate can be formulated with water that includes dissolved solids, and can be formulated with water that can be characterized as hard water.

In certain embodiments, the compositions include from about 0 to about 95 wt-% water, from about 0.1 to about 50 wt-% water, from about 5 to about 50 wt-% water, or from about 10 to about 50 wt-% water. It is to be understood that all values and ranges between these values and ranges are encompassed by the present invention.

Additional Functional Ingredients

The components of the composition can further be combined with various functional components suitable for use in bathroom and other hard surface cleaning applications. In some embodiments, the cleaning compositions include the partially neutralized citric acid salt (and/or fully neutralized ethanolamine citrate salt), neutralizing agent and optionally the surfactant, which make up a large amount, or even substantially all of the total weight of the cleaning compositions. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in the particular use as a bathroom cleaner and/or hard surface cleaner. Some particular examples of functional materials are discussed in more detail below, although the particular materials discussed are given by way of example only, and that a broad variety of other functional ingredients may be used.

In some embodiments the compositions may include preservatives and/or fragrances and/or dyes. In still further embodiments the compositions may include a biocide, antimicrobial, solvents, additional surfactants, dispersants, stabilizing agents, rheology modifiers, carriers, buffers, acid source (e.g. to generate in-situ a partially neutralized citric acid salt using an acid and a fully neutralized citric acid salt), and the like.

Dyes or Odorants

Various dyes, odorants including perfumes, and other aesthetic enhancing agents may also be included in the compositions. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Liquitint Pink AL and the like. Fragrances or perfumes that may be included in the compositions include, for example, terpenoids such as citronellol, aldehydes such as amyl cinnamaldehyde, a jasmine such as ClS-jasmine orjasmal, vanillin, and the like.

In an aspect, the compositions include from about 0 wt-%-20 wt-% dyes and/or odorants, from about 0.001 wt-%-10 wt-% dyes and/or odorants, from about 0.01 wt-%-5 wt-% dyes and/or odorants, preferably from about 0.01 wt-%-2 wt-% dyes and/or odorants. In addition, without being limited according to the invention, all ranges recited are inclusive of the numbers defining the range and include each integer within the defined range.

Solvents and/or Carriers

In some embodiments the compositions may include a carrier and/or solvent. In an aspect, solvents for enhanced soap scum removal properties are not required in the compositions, however, they may be included. The cleaning compositions of the invention may include an organic solvent, preferably a water soluble solvent. In some embodiments, the carrier includes primarily water.

The compositions can comprise one or more solvents including for example: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

Particularly suitable solvents include, but are not limited to: glycol ethers. Suitable glycol ethers include diethylene glycol n-butyl ether, diethylene glycol n-propyl ether, diethylene glycol ethyl ether, diethylene glycol methyl ether, diethylene glycol t-butyl ether, dipropylene glycol n-butyl ether, dipropylene glycol methyl ether, dipropylene glycol ethyl ether, dipropylene glycol propyl ether, dipropylene glycol tert-butyl ether, ethylene glycol butyl ether, ethylene glycol propyl ether, ethylene glycol ethyl ether, ethylene glycol methyl ether, ethylene glycol methyl ether acetate, propylene glycol n-butyl ether, propylene glycol ethyl ether, propylene glycol methyl ether, propylene glycol n-propyl ether, tripropylene glycol methyl ether and tripropylene glycol n-butyl ether, ethylene glycol phenyl ether (commercially available as DOWANOL EPH™ from Dow Chemical Co.), propylene glycol phenyl ether (commercially available as DOWANOL PPH™ from Dow Chemical Co.), and the like, or mixtures thereof.

Additional suitable commercially available glycol ethers (all of which are available from Union Carbide Corp.) include Butoxyethyl PROPASOL™, Butyl CARBITOL™ acetate, Butyl CARBITOL™, Butyl CELLOSOLVE™ acetate, Butyl CELLOSOLVE™, Butyl DIPROPASOL™, Butyl PROPASOL™, CARBITOL™ PM-600, CARBITOL™ Low Gravity, CELLOSOLVE™ acetate, CELLOSOLVE™, Ester EEP™, FILMER IBT™, Hexyl CARBITOL™, Hexyl CELLOSOLVE™, Methyl CARBITOL™, Methyl CELLOSOLVE™ acetate, Methyl CELLOSOLVE™, Methyl DIPROPASOL™, Methyl PROPASOL™ acetate, Methyl PROPASOL™, Propyl CARBITOL™, Propyl CELLOSOLVE™, Propyl DIPROPASOL™ and Propyl PROPASOL™.

In an aspect, the compositions include from about 0 wt-%-20 wt-% solvent and/or carrier, from about 0.01 wt-%-15 wt-% solvent and/or carrier, from about 0.1 wt-%-15 wt-% solvent and/or carrier, preferably from about 1 wt-%-10 wt-% solvent and/or carrier. In addition, without being limited according to the invention, all ranges recited are inclusive of the numbers defining the range and include each integer within the defined range.

Preservatives

In some embodiments, the compositions of the present invention include a preservative. In an aspect, preservatives which do not include a disinfectant component are particularly suited for use in the cleaning compositions. Various preservative compositions known in the art may be employed. An example of a suitable preservative includes those commercially-available under the tradename Kathon® CG/ICP (Rohm & Haas, Philadelphia Pa.).

In an aspect, the compositions include from about 0 wt-%-20 wt-% preservative, from about 0.001 wt-%-10 wt-% preservative, from about 0.01 wt-%-5 wt-% preservative, preferably from about 0.01 wt-%-2 wt-% preservative. In addition, without being limited according to the invention, all ranges recited are inclusive of the numbers defining the range and include each integer within the defined range.

Additional Surfactants

In some embodiments, the compositions of the present invention include additional surfactants and/or other zwitterionic and/or nonionic surfactants as those disclosed supra. The cleaning composition, may include and/or be used in combination with additional surfactants, including co-surfactants. In some embodiments, the additional surfactants may be included in amounts from about 0.01 wt-% or more, or from about 0.1 wt-% or more, or from 1 wt-% or more. It is to be understood that all values and ranges between these values and ranges are encompassed by the present invention.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol™ manufactured by Shell Chemical Co. and Alfonic™ manufactured by Vista Chemical Co.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol™ manufactured by Henkel Corporation and Lipopeg™ manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

Nonionic compounds which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

Nonionic compounds which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

The alkylphenoxypolyethoxyalkanols of U.S. Pat. No. 2,903,486 issued Sep. 8, 1959 to Brown et al. and represented by the formula

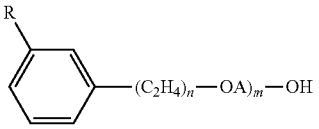

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n$ $(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n$ $(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n$ $(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_XH$, where x is in the range of from 1 to 3.

A useful class of non-ionic surfactants includes the class defined as alkoxylated amines or, most particularly, alcohol alkoxylated/aminated/alkoxylated surfactants. These nonionic surfactants may be at least in part represented by the general formulae: $R^{20}$—$(PO)_SN$-$(EO)_tH$, $R^{20}$—$(PO)_SN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_V$—N $[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch). These references are herein incorporated in their entirety.

Semi-Polar Nonionic Surfactants

The semi-polar type of nonionic surface active agents is another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

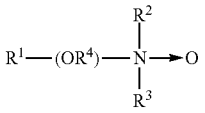

wherein the arrow is a conventional representation of a semi-polar bond; and,$R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

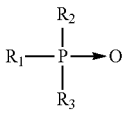

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water solublesulfoxide compounds which have the structure:

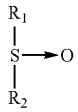

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

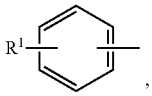

, in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

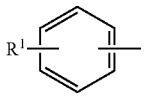

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y—and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

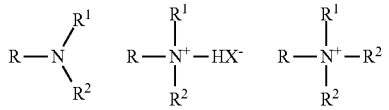

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

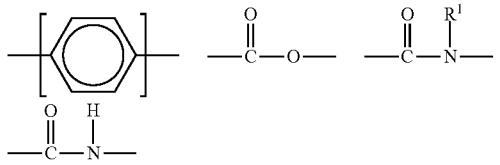

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y is can be a group including, but not limited to:

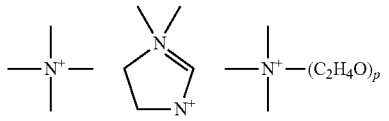

p = about 1 to 12

-continued

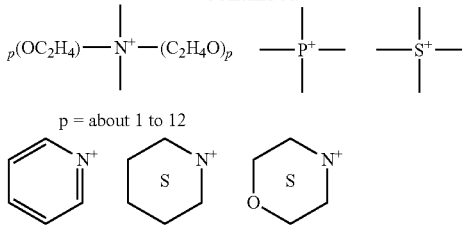

p = about 1 to 12 or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

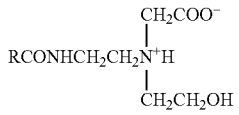

(MONO)ACETATE

-continued

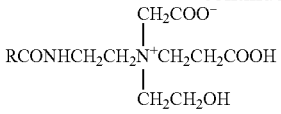

(DI)PROPIONATE

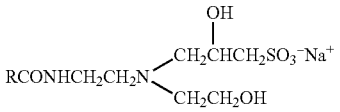

Neutral pH-Zwitternion
AMPHOTERIC
SULFONATE wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R{=}C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Embodiments

Exemplary ranges of the cleaning compositions according to the invention are shown in Tables 1A and 1B in weight percentage of the concentrate and use solution compositions. The compositions of the invention can be formed in a concentrated water-free, aqueous, or a thickened aqueous liquid concentrate for use in forming a use composition. The citric acid salt may include for example, partially neutralized citric acid salts and/or fully neutralized ethanolamine citrate salts as disclosed herein.

TABLE 1A

| | Exemplary Range wt-% | Exemplary Range wt-% | Exemplary Range wt-% | Exemplary Range wt-% |
|---|---|---|---|---|
| Citric Acid | 0.1-65 | 1-65 | 5-65 | 10-50 |
| Neutralizing Agent | 0.1-50 | 0.1-25 | 1-25 | 1-20 |
| Surfactant | 0-50 | 1-50 | 5-50 | 10-30 |
| Water | 0-95 | 0.1-75 | 5-50 | 10-50 |
| Additional Functional Ingredients | 0-50 | 0-20 | 0-10 | 0.1-10 |

TABLE 1B

| | Exemplary Range wt-% | Exemplary Range wt-% | Exemplary Range wt-% | Exemplary Range wt-% |
|---|---|---|---|---|
| Partially Neutralized Citric Acid Salt (or Fully Neutralized Ethanolamine Citrate) | 0.1-65 | 1-65 | 5-65 | 10-50 |
| Surfactant | 0-50 | 1-50 | 5-50 | 10-30 |
| Water | 0-95 | 0.1-75 | 5-50 | 10-50 |
| Additional Functional Ingredients | 0-50 | 0-20 | 0-10 | 0.1-10 |

The cleaning compositions may include concentrate compositions or may be diluted to form use compositions (or provided as ready-to-use). The cleaning compositions may also be provided as diluted ready-to-use compositions. In general, a concentrate refers to a composition that is intended to be diluted with water to provide a use solution that contacts an object to provide the desired cleaning. The cleaning composition that contacts the surfaces to be washed can be referred to as a concentrate or a use composition (or use solution) dependent upon the formulation employed in methods according to the invention. It should be understood that the concentration of the citrate salt soap scum removing active, neutralizing agent, surfactant(s) and other functional ingredients in the composition will vary depending on whether the cleaning composition is provided as a concentrate or as a use solution.

A use solution (and/or a ready-to-use formulation) may be prepared from the liquid concentrate by diluting the concentrate with water at a dilution ratio that provides a use solution having desired soap scum removing properties. The water that is used to dilute the concentrate to form the use composition can be referred to as water of dilution or a diluent, and can vary from one location to another. The typical dilution factor is between approximately 1 to about 16 ounces liquid concentrate per gallon of water diluent, preferably from about 1 to about 12 ounces liquid concentrate per gallon of water diluent, and more preferably from about 8 to about ounces liquid concentrate per gallon of water diluent. In addition, without being limited according to the invention, all dilution ranges recited are inclusive of the numbers defining the range and include each integer within the defined range.

Applications of Use

In preferred aspects, the compositions are suitable for use as bathroom and/or other hard surfaces. In preferred aspects of the invention, methods for using highly effective, safe to use and/or environmentally-friendly bathroom and/or other hard surface cleaning compositions are provided. In addition, methods for using moderately acidic and/or alkaline bathroom and/or other hard surface cleaning compositions are provided. In an aspect, safe to use compositions are provided having a milder pH than commercially-available citric acid-containing compositions. In a preferred aspect, the methods for use according to the invention provide a Green Seal-approved mildly acidic bathroom and/or other hard surface cleaning compositions.

According to the invention, methods of cleaning using the compositions disclosed herein provide a composition comprising a partially neutralized citric acid salt (and/or a fully neutralized ethanolamrine citrate salt) soap scum-removing agent to a soiled surface. According to an aspect of the invention, compositions comprising citric acid are at least partially neutralized in-situ to provide mildly acidic pH ranges that provide at least substantially similar cleaning efficacy, and preferably superior cleaning efficacy, as unneutralized citric acid compositions having a pH below about 3. In addition, the partially neutralized citric acid salt containing cleaning compositions provide at least substantially similar cleaning efficacy, and preferably superior cleaning efficacy, as fully neutralized citric acid compositions (e.g. sodium citrate).

According to the invention, additional methods of cleaning using fully neutralized ethanolamine citrate salts at an approximately neutral pH are provided. At a pH about 7, ethanolamine citrates provided according to the invention greatly outperform monovalent citrates at the same pH and fully neutralized state. In an aspect of the invention, the fully neutralized ethanolamine citrates outperform or provide at least substantially similar cleaning performance as sodium citrate and/or citric acid. Notably, the compositions of the invention achieve such approximately neutral pH cleaning compositions without including a non-biodegradable component, such as for example, EDTA to achieve the same performance. The compositions of the present invention can be used to remove stains from any conventional bathroom surfaces including but not limited to, toilets, shower stalls, racks, curtains, shower doors, bathing appliances, shower bars, bathtubs, bidets, sinks, etc., as well as countertops, walls, floors, etc. Additional hard surfaces which may be cleaned using the compositions of the invention, include for example, counter tops, tile, floors, walls, windows, fixtures, kitchen furniture, appliances, and the like.

The various hard surfaces suitable for cleaning according to the invention include for example, glass; metals; plastics e.g. polyester, vinyl; fiberglass, Formica®, Corian®; refractory materials such as: glazed and unglazed tile, brick, porcelain, ceramics as well as stone including marble, granite, and other stones surfaces; and other hard surfaces known to the industry.

In conventional, industrial and/or commercial bathroom and/or hard surface applications of use, the methods of removing soils from a soiled surface may be employed using concentrated formulation. In such aspects of use employing a concentrated formulation, dilution steps may be initially employed to provide a water source to the concentrated formulation suitable for generating a use solution or use composition. In some aspects, the concentrated cleaning composition may be diluted at a dilution factor between approximately 1 to about 16 ounces liquid concentrate per gallon of water diluent, preferably from about 1 to about 12 ounces liquid concentrate per gallon of water diluent, and more preferably from about 8 to about ounces liquid concentrate per gallon of water diluent. In some aspects, the dilution step occurs at or near a point of use, and may include for example use of a water source that is provided using an aspirator or other dilution mechanism known to the art. In other aspects, when the cleaning composition is employed in a diluted (or a use solution or composition) formulation no further dilution is required by a user.

A particularly well suited method for applying or contacting the cleaning composition to a soiled surface is through the use of a manually operated spray-dispensing container. The spray-dispensing container preferably includes a spray nozzle, a dip tube and associated pump dispensing parts, providing convenient application to soiled bathroom and/or other hard surfaces.

In an embodiment of the methods of the invention, the cleaning composition contacts the surface in need of cleaning. This step may include a contact time from a few seconds to a few minutes, such as from about 30 seconds to about 30 minutes. In such application or contacting step, the user applies an effective amount of the cleaning composition using the spray-dispensing container (or other application means) and within a few seconds to a few minutes thereafter, wipes off the treated area with a rag, towel, sponge or other item (e.g. a disposable paper towel or sponge). In some embodiments involving heavy soil deposits, the cleaning composition may be left on the soiled surface until it has effectively loosened the soil deposits, after which it may be wiped off, rinsed off, or otherwise removed. For particularly heavy deposits of such undesired stains, multiple applications may also be used.

The contacting step may optionally include the use of additional cleaning components, such as for example surfactants, bleaching agents and/or antimicrobial agents. The contacting step may be conducted at a broad range of temperatures, which are not intended to limit the scope of the invention.

In an aspect of the methods of the invention, the cleaning composition may be applied using mechanical force during the contacting step. For example, for removing certain soils from the hard surface additional force may need to be applied, e.g. applying a water source and/or mechanical force to assist in removing soils.

In an additional optional embodiment of the methods of the invention, the cleaning composition may be rinsed from a surface after the initial contacting step. In yet other embodiments the cleaning composition is wiped off the soiled surface, effectively removing the soils and any remaining cleaning composition. In further aspects, there is no need for a rinse step.

According to a still further embodiment of the invention, the cleaning compositions may be employed as a chelant in any medium to low pH cleaning products. In an aspect, the suitable pH ranges for use of the cleaning compositions as chelants within other formulations is between about 4 to about 8, preferably from about 5 to about 7. In addition, without being limited according to the invention, all pH ranges recited are inclusive of the numbers defining the range and include each integer within the defined range. Without being limited to a particular mechanism of action, the use of the cleaning compositions as a chelant in other formulations having pH between about 4 to about 8, is a further application of use of the present invention as the partially neutralized compositions provide unexpected chelating strength that surpasses the strength of citric acid alone. Although there is little to no "acid strength" provided by the partially neutralized citric acid salt containing compositions (and/or fully neutralized ethanolamine citrate salt containing compositions), the chelating efficacy is significant.

Those skilled in the art will recognize, or be able to ascertain using no more than routine experimentation, numerous equivalents to the specific procedures, embodiments, claims, and examples described herein. Such equivalents are considered to be within the scope of this invention and covered by the claims appended hereto. The contents of all references, patents, and patent applications cited throughout this application are indicative of the level of ordinary skill in the art to which this invention pertains, and are hereby incorporated by reference. The invention is further illustrated by the following examples, which should not be construed as further limiting.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

A test method for using prepared soils on clean glass slides for use in product development and product comparison of bathroom and shower cleaners was developed. As both citric acid (primarily below a pH of 3) and sodium citrate (at a pH near 7) have been used as bathroom cleaners for many years, the comparison to cleaning efficacy of these commercial compositions was evaluated using various partially-neutralized citric acid salt compositions according to the invention.

Soils were prepared using distilled water, casein protein, ivory soap, Crisco, kalin clay, hardness sources ($MgCl_2$ or $MgCl_2$-$6H_2O$, $CaCl_2$ or $CaCl_2$-$2H_2O$), $NaHCO_3$, and NaOH (50%). The casein protein was added to cool water under vigorous stirring and allowed to stir for at least 30 minutes. The solution was then heated to about 50° C. The soap was added to the solution when a temperature of at least 40° C. was reached and the soap was dissolved. Then the following were added: Crisco under vigorous stirring; Kalin clay under vigorous stirring; hardness sources. Next the solutions were warmed to prevent excessive precipitation. The solution was stirred for at least five minutes before adding approximately 3 drops of 50% NaOH or enough to raise the pH to approximately 8.75. Then the solution was again stirred vigorously for 30 minutes.

Hard water solution were prepared by the following methods: approximately 1200 mL of DI water was brought to a boil and then allowed to cool to room temperature. The requisite salts were dissolved into approximately 700 mL of the boiled water and then transferred into a 1000 mL volumetric flask. The solution was then brought to a boil.

Approximately 0.50 grams of the soils were then applied to slides. The soils were allowed to dry completely (at least four hours or overnight). After drying, the slides were baked for 30 minutes in the Yamato DKN602 oven at a temperature of 200° C. The slides were allowed to cool and then weighted to calculate the amount of soil applied to each slide.

Cleaning test methods: the sponges were cut in half such that they were 3"×3.6" and then rinsed thoroughly to remove all anti-microbial additives. Approximately 300 g of use solution of each product was prepared. A sponge was soaked in the first product and wrong out thoroughly before applying 15 g of product over one side of the sponge. The "product-applied" side was placed down in the carriage. One or two slides were placed into the slide template. 5 sprays of product were sprayed onto each test slide and allowed to dwell for 30 seconds. The Gardner cycle was run for 15 cycles before removing the slides and rinsing them thoroughly under running DI water. The slides were allowed to dry for at least 4 hours and the final weight was measured. Test results were reported as the average weight loss (and standard deviation of the replicates of each different condition were tested).

Test compositions were made using the following wt-% ranges of components, as shown in Table 2.

TABLE 2

| | NaOH | KOH | LiOH | $MG(OH)_2$ | MEA | DEA | TEA |
|---|---|---|---|---|---|---|---|
| Water | 50-65 | 50-70 | 60-70 | 65-70 | 60-70 | 50-70 | 45-68 |
| Citric Acid (50%) | 15-25 | 15-25 | 15-25 | 15-25 | 15-25 | 15-25 | 15-25 |
| NaOH | 2-13 | | | | | | |
| KOH (45%) | | 3-20 | | | | | |
| LiOH | | | 1-10 | | | | |
| $MG(OH)_2$ | | | | 0.5-5 | | | |
| MEA | | | | | 1-10 | | |
| DEA | | | | | | 2-18 | |
| TEA | | | | | | | 3-25 |
| Glucopon 425 | 5-15 | 5-15 | 5-15 | 5-15 | 5-15 | 5-15 | 5-15 |

The soil removal results obtained from each of the test compositions set forth in Table 2 are shown below in Tables 3-9, wherein a data point with strikethrough represents extrapolated data due to a broken slide. The amounts of the varying neutralizing alkalinity sources is based on the molar ratio of the alkalinity source to the acid components of the citric acid (the carboxylic acid groups). For example, in Table 3, Formula Na 6 represents 3 moles of alkalinity per mole of citric acid. The various formulas tested we done in 0.5 increments of from 0 moles alkalinity to 3 moles alkalinity per 1 mole of acid.

TABLE 3

| Formula | Slide | Conc pH | Use pH | Initial | Final | Wt. Loss (mg) | Avg | StDev | Normalize to Citric Only |
|---|---|---|---|---|---|---|---|---|---|
| Citric | 1 | 1.76 | 2.43 | 9.4375 | 9.4285 | 9 | 9.00 | 0.000 | 1.000 |
| Only | 2 | | | 9.4202 | 9.4112 | 9 | | | |
| | 3 | | | 9.443 | 9.434 | 9 | | | |
| | 2-1 | | | 9.4914 | 9.4823 | 9.1 | 8.87 | 0.208 | |
| | 2-2 | | | 9.5295 | 9.5207 | 8.8 | | | |
| | 2-3 | | | 9.5425 | 9.5338 | 8.7 | | | |
| Na 1 | 4 | 2.92 | 3.15 | 9.4456 | 9.4365 | 9.1 | 9.07 | 0.252 | 1.007 |
| | 5 | | | 9.4059 | 9.3971 | 8.8 | | | |
| | 6 | | | 9.4091 | 9.3998 | 9.3 | | | |
| | 2-4 | | | 9.5393 | 9.5307 | 8.6 | 8.73 | 0.115 | 0.98 |
| | 2-5 | | | 9.5394 | 9.5306 | 8.8 | | | |
| | 2-6 | | | 9.5275 | 9.5187 | 8.8 | | | |
| Na 2 | 7 | 3.56 | 3.84 | 9.3983 | 9.3891 | 9.2 | 8.77 | 0.404 | 0.974 |
| | 8 | | | 9.4597 | 9.4513 | 8.4 | | | |
| | 9 | | | 9.3805 | 9.3718 | 8.7 | | | |
| | 2-7 | | | 9.5375 | 9.5295 | 8.0 | 8.00 | 0.000 | 0.90 |
| | 2-8 | | | 9.5569 | 9.5489 | 8.0 | | | |
| | 2-9 | | | 9.4862 | 9.4782 | 8.0 | | | |
| Na 3 | 10 | 4.13 | 4.49 | 9.4658 | 9.4568 | 9 | 9.10 | 0.100 | 1.011 |
| | 11 | | | 9.4033 | 9.3941 | 9.2 | | | |
| | 12 | | | 9.4179 | 9.4088 | 9.1 | | | |
| | 2-10 | | | 9.5245 | 9.5164 | 8.1 | 8.13 | 0.153 | 0.92 |
| | 2-11 | | | 9.2211 | 9.2131 | 8.0 | | | |
| | 2-12 | | | 9.5095 | 9.5012 | 8.3 | | | |
| Na 4 | 13 | 4.69 | 5.17 | 9.4092 | 9.3994 | 9.8 | 9.63 | 0.153 | 1.070 |
| | 14 | | | 9.4276 | 9.4181 | 9.5 | | | |
| | 15 | | | 9.443 | 9.4334 | 9.6 | | | |
| | 2-13 | | | 9.5089 | 9.4998 | 9.1 | 9.07 | 0.153 | 1.02 |
| | 2-14 | | | 9.43 | 9.4211 | 8.9 | | | |
| | 2-15 | | | 9.468 | 9.4588 | 9.2 | | | |
| Na 5 | 16 | 5.22 | 5.79 | 9.19 | 9.1808 | 9.2 | 8.90 | 0.265 | 0.989 |
| | 17 | | | 9.5108 | 9.502 | 8.8 | | | |
| | 18 | | | 9.5281 | 9.5194 | 8.7 | | | |
| | 2-16 | | | 9.4664 | 9.4583 | 8.1 | 8.20 | 0.100 | 0.92 |
| | 2-17 | | | 9.4328 | 9.4246 | 8.2 | | | |
| | 2-18 | | | 9.4824 | 9.4741 | 8.3 | | | |
| Na 6 | 19 | 6.44 | 6.95 | 9.527 | 9.5192 | 7.8 | 7.70 | 0.173 | 0.856 |
| | 20 | | | 9.5504 | 9.5426 | 7.8 | | | |
| | 21 | | | 9.525 | 9.5175 | 7.5 | | | |
| | 2-19 | | | 9.4482 | 9.4412 | 7.0 | 6.83 | 0.208 | 0.78 |
| | 2-20 | | | 9.4653 | 9.4584 | 6.9 | | | |
| | 2-21 | | | 9.4378 | 9.4312 | 6.6 | | | |

TABLE 4

| Formula | Slide | Conc pH | Use pH | Initial | Final | Wt. Loss (mg) | Avg | StDev | Normalize to Citric Only |
|---|---|---|---|---|---|---|---|---|---|
| Citric | 1 | 1.76 | 2.46 | 9.5511 | 9.542 | 9.1 | 9.20 | 0.265 | 1 |
| Only | 2 | | | 9.515 | 9.5055 | 9.5 | | | |
| | 3 | | | 9.5315 | 9.5225 | 9 | | | |
| | 2-1 | | | 9.5418 | 9.5333 | 8.5 | 8.30 | 0.200 | |
| | 2-2 | | | 9.5485 | 9.5404 | 8.1 | | | |
| | 2-3 | | | 9.4519 | 9.4436 | 8.3 | | | |
| K 1 | 4 | 2.88 | 3.14 | 9.5517 | 9.543 | 8.7 | 9.00 | 0.300 | 0.98 |
| | 5 | | | 9.5575 | 9.5485 | 9 | | | |
| | 6 | | | 9.5467 | 9.5374 | 9.3 | | | |
| | 2-4 | | | 9.3462 | 9.3378 | 8.4 | 8.17 | 0.208 | 0.98 |
| | 2-5 | | | 9.3611 | 9.3531 | 8.0 | | | |
| | 2-6 | | | 9.3358 | 9.3277 | 8.1 | | | |
| K 2 | 7 | 3.61 | 3.84 | 9.5183 | 9.5098 | 8.5 | 8.47 | 0.153 | 0.92 |
| | 8 | | | 9.5531 | 9.5448 | 8.3 | | | |
| | 9 | | | 9.5242 | 9.5156 | 8.6 | | | |
| | 2-7 | | | 9.3479 | 9.3404 | 7.5 | 7.73 | 0.208 | 0.93 |
| | 2-8 | | | 9.3488 | 9.3409 | 7.9 | | | |
| | 2-9 | | | 9.3706 | 9.3628 | 7.8 | | | |

TABLE 4-continued

| Formula | Slide | Conc pH | Use pH | Initial | Final | Wt. Loss (mg) | Avg | StDev | Normalize to Citric Only |
|---|---|---|---|---|---|---|---|---|---|
| K 3 | 10 | 4.27 | 4.51 | 9.5734 | 9.5647 | 8.7 | 8.63 | 0.058 | 0.94 |
| | 11 | | | 9.4084 | 9.3998 | 8.6 | | | |
| | 12 | | | 9.4332 | 9.4246 | 8.6 | | | |
| | 2-10 | | | 9.3507 | 9.3431 | 7.6 | 7.80 | 0.200 | 0.94 |
| | 2-11 | | | 9.3643 | 9.3565 | 7.8 | | | |
| | 2-12 | | | 9.3566 | 9.3486 | 8.0 | | | |
| K 4 | 13 | 4.89 | 5.21 | 9.4013 | 9.3921 | 9.2 | 9.43 | 0.252 | 1.03 |
| | 14 | | | 9.4005 | 9.3911 | 9.4 | | | |
| | 15 | | | 9.4118 | 9.4021 | 9.7 | | | |
| | 2-13 | | | 9.3441 | 9.336 | 8.1 | 8.23 | 0.153 | 0.99 |
| | 2-14 | | | 9.3752 | 9.3668 | 8.4 | | | |
| | 2-15 | | | 9.3465 | 9.3383 | 8.2 | | | |
| K 5 | 16 | 5.53 | 5.9 | 9.3672 | 9.3589 | 8.3 | 8.33 | 0.058 | 0.91 |
| | 17 | | | 9.4281 | 9.4197 | 8.4 | | | |
| | 18 | | | 9.3965 | 9.3882 | 8.3 | | | |
| | 2-16 | | | 9.41 | 9.4023 | 7.7 | 7.53 | 0.208 | 0.91 |
| | 2-17 | | | 9.3924 | 9.3848 | 7.6 | | | |
| | 2-18 | | | 9.4028 | 9.3955 | 7.3 | | | |
| K 6 | 19 | 7.35 | 7.07 | 9.3753 | 9.3681 | 7.2 | 7.40 | 0.265 | 0.80 |
| | 20 | | | 9.3849 | 9.3772 | 7.7 | | | |
| | 21 | | | 9.3833 | 9.376 | 7.3 | | | |
| | 2-19 | | | 9.365 | 9.3586 | 6.4 | 6.60 | 0.200 | 0.81 |
| | 2-20 | | | 9.3754 | ~~9.3634~~ | 6.6 | | | |
| | 2-21 | | | 9.3787 | 9.3719 | 6.8 | | | |

TABLE 5

| Formula | Slide | Conc pH | Use pH | Initial | Final | Wt. Loss (mg) | Avg | StDev | Normalize to Citric Only |
|---|---|---|---|---|---|---|---|---|---|
| Citric Only | 1 | 1.76 | 2.46 | 9.573 | 9.5643 | 8.7 | 9.07 | 0.351 | 1 |
| | 2 | | | 9.5116 | 9.5025 | 9.1 | | | |
| | 3 | | | 9.5018 | 9.4924 | 9.4 | | | |
| | 2-1 | | | 9.3872 | 9.3788 | 8.4 | 8.40 | 0.300 | |
| | 2-2 | | | 9.3679 | 9.3598 | 8.1 | | | |
| | 2-3 | | | 9.3804 | 9.3717 | 8.7 | | | |
| Li 1 | 4 | 2.87 | 3.18 | 9.5188 | 9.51 | 8.8 | 8.80 | 0.200 | 0.97 |
| | 5 | | | 9.5554 | 9.5468 | 8.6 | | | |
| | 6 | | | 9.5229 | 9.5139 | 9.0 | | | |
| | 2-4 | | | 9.3952 | 9.3868 | 8.4 | 8.40 | 0.300 | 1.00 |
| | 2-5 | | | 9.3691 | 9.3604 | 8.7 | | | |
| | 2-6 | | | 9.4132 | 9.4051 | 8.1 | | | |
| Li 2 | 7 | 3.50 | 3.87 | 9.5542 | 9.546 | 8.2 | 8.30 | 0.361 | 0.92 |
| | 8 | | | 9.5561 | 9.5474 | 8.7 | | | |
| | 9 | | | 9.5377 | 9.5297 | 8.0 | | | |
| | 2-7 | | | 9.4005 | 9.3926 | 7.9 | 8.20 | 0.361 | 0.98 |
| | 2-8 | | | 9.3252 | 9.3166 | 8.6 | | | |
| | 2-9 | | | 9.3711 | 9.363 | 8.1 | | | |
| Li 3 | 10 | 4.05 | 4.53 | 9.575 | 9.567 | 8.0 | 8.50 | 0.781 | 0.94 |
| | 11 | | | 9.5607 | 9.5513 | 9.4 | | | |
| | 12 | | | 9.3658 | 9.3577 | 8.1 | | | |
| | 2-10 | | | 9.3399 | 9.3318 | 8.1 | 8.13 | 0.153 | 0.97 |
| | 2-11 | | | 9.3367 | 9.3284 | 8.3 | | | |
| | 2-12 | | | 9.3794 | 9.3714 | 8.0 | | | |
| Li 4 | 13 | 4.53 | 5.15 | 9.3223 | 9.3124 | 9.9 | 9.83 | 0.058 | 1.08 |
| | 14 | | | 9.3503 | 9.3405 | 9.8 | | | |
| | 15 | | | 9.3738 | 9.364 | 9.8 | | | |
| | 2-13 | | | 9.3506 | 9.3421 | 8.5 | 8.50 | 0.100 | 1.01 |
| | 2-14 | | | 9.3592 | 9.3506 | 8.6 | | | |
| | 2-15 | | | 9.3646 | 9.3562 | 8.4 | | | |
| Li 5 | 16 | 5.05 | 5.80 | 9.3743 | 9.3653 | 9.0 | 8.73 | 0.231 | 0.96 |
| | 17 | | | 9.3209 | 9.3123 | 8.6 | | | |
| | 18 | | | 9.3219 | 9.3133 | 8.6 | | | |
| | 2-16 | | | 9.4031 | 9.3953 | 7.8 | 7.87 | 0.115 | 0.94 |
| | 2-17 | | | 9.3708 | 9.3628 | 8.0 | | | |
| | 2-18 | | | 9.376 | 9.3682 | 7.8 | | | |

TABLE 5-continued

| Formula | Slide | Conc pH | Use pH | Initial | Final | Wt. Loss (mg) | Avg | StDev | Normalize to Citric Only |
|---|---|---|---|---|---|---|---|---|---|
| Li 6 | 19 | 6.21 | 7.04 | 9.2772 | 9.2698 | 7.4 | 7.40 | 0.200 | 0.84 |
| | 20 | | | 9.334 | 9.3264 | 7.6 | | | |
| | 21 | | | 9.3301 | 9.3229 | 7.2 | | | |
| | 2-19 | | | 9.3645 | 9.3577 | 6.8 | 6.80 | 0.100 | 0.81 |
| | 2-20 | | | 9.3332 | 9.3265 | 6.7 | | | |
| | 2-21 | | | 9.3775 | 9.3706 | 6.9 | | | |

TABLE 6

| Formula | Slide | Conc pH | Use pH | Initial | Final | Wt. Loss (mg) | Avg | StDev | Normalize to Citric Only |
|---|---|---|---|---|---|---|---|---|---|
| Citric Only | 1 | 1.76 | 2.43 | 9.5031 | 9.494 | 9.1 | 9.23 | 0.321 | 1 |
| | 2 | | | 9.4892 | 9.4802 | 9 | | | |
| | 3 | | | 9.5342 | 9.5246 | 9.6 | | | |
| | 2-1 | | | 9.3638 | 9.3552 | 8.6 | 8.80 | 0.265 | |
| | 2-2 | | | 9.3558 | 9.3471 | 8.7 | | | |
| | 2-3 | | | 9.3526 | 9.3435 | 9.1 | | | |
| Mg 1 | 4 | 3.13 | 3.66 | 9.5077 | 9.4987 | 9 | 8.87 | 0.231 | 0.96 |
| | 5 | | | 9.4732 | 9.4642 | 9 | | | |
| | 6 | | | 9.4942 | 9.4856 | 8.6 | | | |
| | 2-4 | | | 9.3502 | 9.3417 | 8.5 | 8.87 | 0.321 | 1.01 |
| | 2-5 | | | 9.3348 | 9.3258 | 9.0 | | | |
| | 2-6 | | | 9.362 | 9.3529 | 9.1 | | | |
| Mg 1.5 | 7 | 3.46 | 4.03 | 9.5441 | 9.5362 | 7.9 | 8.43 | 0.473 | 0.91 |
| | 8 | | | 9.4921 | 9.4835 | 8.6 | | | |
| | 9 | | | 9.4803 | 9.4715 | 8.8 | | | |
| | 2-7 | | | 9.3491 | 9.3403 | 8.8 | 8.43 | 0.351 | 0.96 |
| | 2-8 | | | 9.3493 | 9.3409 | 8.4 | | | |
| | 2-9 | | | 9.3405 | 9.3324 | 8.1 | | | |
| Mg 2 | 10 | 3.72 | 4.33 | 9.4969 | 9.4881 | 8.8 | 8.37 | 0.404 | 0.91 |
| | 11 | | | 9.1816 | 9.1736 | 8 | | | |
| | 12 | | | 9.1635 | 9.1552 | 8.3 | | | |
| | 2-10 | | | 9.3342 | 9.3261 | 8.1 | 8.10 | 0.000 | 0.92 |
| | 2-11 | | | 9.3058 | 9.2977 | 8.1 | | | |
| | 2-12 | | | 9.3497 | 9.3416 | 8.1 | | | |
| Mg 2.5 | 13 | 4.13 | 4.69 | 9.2201 | 9.2119 | 8.2 | 7.83 | 0.321 | 0.85 |
| | 14 | | | 9.1873 | 9.1796 | 7.7 | | | |
| | 15 | | | 9.1692 | 9.1616 | 7.6 | | | |
| | 2-13 | | | 9.3585 | 9.3505 | 8.0 | 7.97 | 0.252 | 0.91 |
| | 2-14 | | | 9.3508 | 9.3426 | 8.2 | | | |
| | 2-15 | | | 9.3758 | 9.3681 | 7.7 | | | |
| Mg 3 | 16 | 4.84 | 5.65 | 9.1877 | 9.181 | 6.7 | 6.77 | 0.115 | 0.73 |
| | 17 | | | 9.1765 | 9.1696 | 6.9 | | | |
| | 18 | | | 9.2223 | 9.2156 | 6.7 | | | |
| | 2-16 | | | 9.3143 | 9.3064 | 7.9 | 7.83 | 0.208 | 0.89 |
| | 2-17 | | | 9.3246 | 9.317 | 7.6 | | | |
| | 2-18 | | | 9.356 | 9.348 | 8.0 | | | |
| Mg 4 | 19 | NR | NR | 9.3311 | 9.3248 | 6.3 | 6.23 | 0.058 | 0.70 |
| | 20 | | | 9.348 | 9.3418 | 6.2 | | | |
| | 21 | | | 9.3582 | 9.352 | 6.2 | | | |

TABLE 7

| Formula | Slide | Conc pH | Use pH | Initial | Final | Wt. Loss (mg) | Avg | StDev | Normalize to Citric Only |
|---|---|---|---|---|---|---|---|---|---|
| Citric Only | 1 | NR | 2.42 | 9.3608 | 9.3519 | 8.9 | 9.13 | 0.208 | 1 |
| | 2 | | | 9.3715 | 9.3622 | 9.3 | | | |
| | 3 | | | 9.3636 | 9.3544 | 9.2 | | | |
| | 2-1 | | | 9.3301 | 9.3212 | 8.9 | 8.97 | 0.208 | |
| | 2-2 | | | 9.306 | 9.2972 | 8.8 | | | |
| | 2-3 | | | 9.359 | 9.3498 | 9.2 | | | |
| MEA 1 | 4 | 2.85 | 3.12 | 9.3847 | 9.3755 | 9.2 | 9.23 | 0.153 | 1.01 |
| | 5 | | | 9.386 | 9.3766 | 9.4 | | | |
| | 6 | | | 9.195 | 9.1859 | 9.1 | | | |
| | 2-4 | | | 9.3623 | 9.3536 | 8.7 | 8.60 | 0.100 | 0.96 |
| | 2-5 | | | 9.3242 | 9.3157 | 8.5 | | | |
| | 2-6 | | | 9.286 | 9.2774 | 8.6 | | | |

TABLE 7-continued

| Formula | Slide | Conc pH | Use pH | Initial | Final | Wt. Loss (mg) | Avg | StDev | Normalize to Citric Only |
|---|---|---|---|---|---|---|---|---|---|
| MEA 2 | 7 | 3.51 | 3.79 | 9.2075 | 9.1991 | 8.4 | 8.37 | 0.058 | 0.92 |
| | 8 | | | 9.2048 | 9.1965 | 8.3 | | | |
| | 9 | | | 9.229 | 9.2206 | 8.4 | | | |
| | 2-7 | | | 9.3245 | 9.3163 | 8.2 | 8.20 | 0.200 | 0.91 |
| | 2-8 | | | 9.3333 | 9.3249 | 8.4 | | | |
| | 2-9 | | | 9.3471 | 9.3391 | 8.0 | | | |
| MEA 3 | 10 | 4.13 | 4.46 | 9.2327 | 9.2234 | 9.3 | 9.17 | 0.115 | 1.00 |
| | 11 | | | 9.1836 | 9.1745 | 9.1 | | | |
| | 12 | | | 9.1927 | 9.1836 | 9.1 | | | |
| | 2-10 | | | 9.3791 | 9.3705 | 8.6 | 8.57 | 0.058 | 0.96 |
| | 2-11 | | | 9.3308 | 9.3223 | 8.5 | | | |
| | 2-12 | | | 9.3032 | 9.2946 | 8.6 | | | |
| MEA 4 | 13 | 4.72 | 5.14 | 9.1857 | 9.1764 | 9.3 | 9.37 | 0.115 | 1.03 |
| | 14 | | | 9.1946 | 9.1851 | 9.5 | | | |
| | 15 | | | 9.2264 | 9.2171 | 9.3 | | | |
| | 2-13 | | | 9.3501 | 9.3408 | 9.3 | 9.27 | 0.058 | 1.03 |
| | 2-14 | | | 9.3405 | 9.3313 | 9.2 | | | |
| | 2-15 | | | 9.3392 | 9.3299 | 9.3 | | | |
| MEA 5 | 16 | 5.31 | 5.81 | 9.1551 | 9.1464 | 8.7 | 8.87 | 0.289 | 0.97 |
| | 17 | | | 9.2013 | 9.1921 | 9.2 | | | |
| | 18 | | | 9.198 | 9.1893 | 8.7 | | | |
| | 2-16 | | | 9.3522 | 9.3436 | 8.6 | 8.83 | 0.208 | 0.99 |
| | 2-17 | | | 9.3548 | 9.3458 | 9.0 | | | |
| | 2-18 | | | 9.3331 | 9.3242 | 8.9 | | | |
| MEA 6 | 19 | 6.46 | 6.85 | 9.1951 | 9.1861 | 9 | 9.07 | 0.058 | 0.99 |
| | 20 | | | 9.1743 | 9.1652 | 9.1 | | | |
| | 21 | | | 9.1767 | 9.1676 | 9.1 | | | |
| | 2-19 | | | 9.4921 | 9.4833 | 8.8 | 8.57 | 0.208 | 0.96 |
| | 2-20 | | | 9.4377 | 9.4292 | 8.5 | | | |
| | 2-21 | | | 9.4438 | 9.4354 | 8.4 | | | |

TABLE 8

| Formula | Slide | Conc pH | Use pH | Initial | Final | Wt. Loss (mg) | Avg | StDev | Normalize to Citric Only |
|---|---|---|---|---|---|---|---|---|---|
| Citric Only | 1 | 1.76 | 2.43 | 9.1674 | 9.1584 | 9 | 9.10 | 0.173 | 1 |
| | 2 | | | 9.195 | 9.186 | 9 | | | |
| | 3 | | | 9.1464 | 9.1371 | 9.3 | | | |
| | 2-1 | | | 9.4694 | 9.4604 | 9.0 | 9.00 | 0.000 | |
| | 2-2 | | | 9.4756 | 9.4666 | 9.0 | | | |
| | 2-3 | | | 9.4927 | 9.4837 | 9.0 | | | |
| DEA 1 | 4 | 2.89 | 3.18 | 9.1469 | 9.1379 | 9 | 9.00 | 0.000 | 0.99 |
| | 5 | | | 9.1762 | 9.1672 | 9 | | | |
| | 6 | | | 9.1939 | 9.1849 | 9 | | | |
| | 2-4 | | | 9.467 | 9.4581 | 8.9 | 8.73 | 0.208 | 0.97 |
| | 2-5 | | | 9.4679 | 9.4591 | 8.8 | | | |
| | 2-6 | | | 9.3166 | 9.3081 | 8.5 | | | |
| DEA 2 | 7 | 3.55 | 3.84 | 9.2152 | 9.2067 | 8.5 | 8.47 | 0.058 | 0.93 |
| | 8 | | | 9.162 | 9.1535 | 8.5 | | | |
| | 9 | | | 9.1813 | 9.1729 | 8.4 | | | |
| | 2-7 | | | 9.3101 | 9.3019 | 8.2 | 8.30 | 0.100 | 0.92 |
| | 2-8 | | | 9.3566 | 9.3482 | 8.4 | | | |
| | 2-9 | | | 9.3706 | 9.3623 | 8.3 | | | |
| DEA 3 | 10 | 4.19 | 4.51 | 9.2032 | 9.1944 | 8.8 | 8.77 | 0.153 | 0.96 |
| | 11 | | | 9.1723 | 9.1637 | 8.6 | | | |
| | 12 | | | 9.1689 | 9.16 | 8.9 | | | |
| | 2-10 | | | 9.3791 | 9.3709 | 8.2 | 8.43 | 0.208 | 0.94 |
| | 2-11 | | | 9.3242 | 9.3157 | 8.5 | | | |
| | 2-12 | | | 9.32 | 9.3114 | 8.6 | | | |
| DEA 4 | 13 | 4.78 | 5.18 | 9.1637 | 9.1538 | 9.9 | 9.87 | 0.451 | 1.08 |
| | 14 | | | 9.1714 | 9.162 | 9.4 | | | |
| | 15 | | | 9.1917 | 9.1814 | 10.3 | | | |
| | 2-13 | | | 9.3242 | 9.3149 | 9.3 | 8.97 | 0.306 | 1.00 |
| | 2-14 | | | 9.3234 | 9.3145 | 8.9 | | | |
| | 2-15 | | | 9.3482 | 9.3395 | 8.7 | | | |

TABLE 8-continued

| Formula | Slide | Conc pH | Use pH | Initial | Final | Wt. Loss (mg) | Avg | StDev | Normalize to Citric Only |
|---|---|---|---|---|---|---|---|---|---|
| DEA 5 | 16 | 5.27 | 5.72 | 9.1622 | 9.1533 | 8.9 | 8.67 | 0.252 | 0.95 |
| | 17 | | | 9.1668 | 9.1581 | 8.7 | | | |
| | 18 | | | 9.1904 | 9.182 | 8.4 | | | |
| | 2-16 | | | 9.3162 | 9.3079 | 8.3 | 8.37 | 0.115 | 0.93 |
| | 2-17 | | | 9.3362 | 9.3279 | 8.3 | | | |
| | 2-18 | | | 9.3088 | 9.3003 | 8.5 | | | |
| DEA 6 | 19 | 6.36 | 6.77 | 9.2082 | 9.1996 | 8.6 | 8.33 | 0.306 | 0.93 |
| | 20 | | | 9.1772 | 9.1688 | 8.4 | | | |
| | 21 | | | 9.1851 | 9.1771 | 8 | | | |
| | 2-19 | | | 9.3181 | 9.3101 | 8.0 | 7.97 | 0.058 | 0.91 |
| | 2-20 | | | 9.3453 | 9.3373 | 8.0 | | | |
| | 2-21 | | | 9.3226 | 9.3147 | 7.9 | | | |

TABLE 9

| Formula | Slide | Conc pH | Use pH | Initial | Final | Wt. Loss (mg) | Avg | StDev | Normalize to Citric Only |
|---|---|---|---|---|---|---|---|---|---|
| Citric Only | 1 | 1.76 | 2.43 | 9.1793 | 9.1702 | 9.1 | 9.23 | 0.115 | 1 |
| | 2 | | | 9.1612 | 9.1519 | 9.3 | | | |
| | 3 | | | 9.1592 | 9.1499 | 9.3 | | | |
| | 2-1 | | | 9.3417 | 9.333 | 8.7 | 8.83 | 0.115 | |
| | 2-2 | | | 9.3389 | 9.33 | 8.9 | | | |
| | 2-3 | | | 9.338 | 9.3291 | 8.9 | | | |
| TEA 1 | 4 | 2.83 | 3.11 | 9.1658 | 9.1567 | 9.1 | 9.10 | 0.100 | 0.99 |
| | 5 | | | 9.1723 | 9.1631 | 9.2 | | | |
| | 6 | | | 9.1569 | 9.1479 | 9 | | | |
| | 2-4 | | | 9.3481 | 9.3387 | 9.4 | 9.23 | 0.208 | 1.05 |
| | 2-5 | | | 9.3287 | 9.3194 | 9.3 | | | |
| | 2-6 | | | 9.3188 | 9.3098 | 9.0 | | | |
| TEA 2 | 7 | 3.59 | 3.86 | 9.1843 | 9.1754 | 8.9 | 9.00 | 0.100 | 0.97 |
| | 8 | | | 9.1268 | 9.1177 | 9.1 | | | |
| | 9 | | | 9.1618 | 9.1528 | 9 | | | |
| | 2-7 | | | 9.3185 | 9.31 | 8.5 | 8.57 | 0.208 | 0.97 |
| | 2-8 | | | 9.2947 | 9.2859 | 8.8 | | | |
| | 2-9 | | | 9.3578 | 9.3494 | 8.4 | | | |
| TEA 3 | 10 | 4.24 | 4.52 | 9.1871 | 9.1786 | 8.5 | 9.23 | 0.635 | 1.00 |
| | 11 | | | 9.184 | 9.1744 | 9.6 | | | |
| | 12 | | | 9.1622 | 9.1526 | 9.6 | | | |
| | 2-10 | | | 9.317 | 9.3079 | 9.1 | 8.83 | 0.379 | 1.00 |
| | 2-11 | | | 9.3237 | 9.3147 | 9.0 | | | |
| | 2-12 | | | 9.3533 | 9.3449 | 8.4 | | | |
| TEA 4 | 13 | 4.88 | 5.2 | 9.1852 | 9.1757 | 9.5 | 9.60 | 0.100 | 1.04 |
| | 14 | | | 9.167 | 9.1573 | 9.7 | | | |
| | 15 | | | 9.1656 | 9.156 | 9.6 | | | |
| | 2-13 | | | 9.3554 | 9.3456 | 9.8 | 9.40 | 0.400 | 1.06 |
| | 2-14 | | | 9.3314 | 9.3224 | 9.0 | | | |
| | 2-15 | | | 9.3487 | 9.3393 | 9.4 | | | |
| TEA 5 | 16 | 5.53 | 5.89 | 9.1485 | 9.1396 | 8.9 | 9.20 | 0.265 | 1.00 |
| | 17 | | | 9.1965 | 9.1871 | 9.4 | | | |
| | 18 | | | 9.1997 | 9.1904 | 9.3 | | | |
| | 2-16 | | | 9.3706 | 9.3616 | 9.0 | 9.10 | 0.100 | 1.03 |
| | 2-17 | | | 9.3453 | 9.3362 | 9.1 | | | |
| | 2-18 | | | 9.3413 | 9.3321 | 9.2 | | | |
| TEA 6 | 19 | 6.53 | 6.63 | 9.1967 | 9.1879 | 8.8 | 8.87 | 0.404 | 0.97 |
| | 20 | | | 9.1761 | 9.1668 | 9.3 | | | |
| | 21 | | | 9.1949 | 9.1864 | 8.5 | | | |
| | 2-19 | | | 9.3626 | 9.3541 | 8.5 | 8.47 | 0.058 | 0.92 |
| | 2-20 | | | 9.3765 | 9.368 | 8.5 | | | |
| | 2-21 | | | 9.3286 | 9.3202 | 8.4 | | | |

FIG. 1 shows the soil removal using the various hydroxide alkalinity sources according to the invention for partial neutralization of citric acid to provide partially neutralized citric acid salts. The amount of the various monovalent hydroxide sources and the divalent hydroxide (magnesium hydroxide) alkalinity source are shown in moles of alkalinity per mole of citric acid. Notably, the divalent hydroxide magnesium hydroxide did not produce a performance peak. Instead, performance dropped from a maximum at no neutralization to a minimum at full neutralization. For the various monovalent hydroxide alkalinity sources, there was a decrease in soil removal when the compounds were ⅓ neutralized (1 mole alkalinity per 1 mole acid). However, a significant performance increase began at about ⅔ neutralization.

Figure 2:
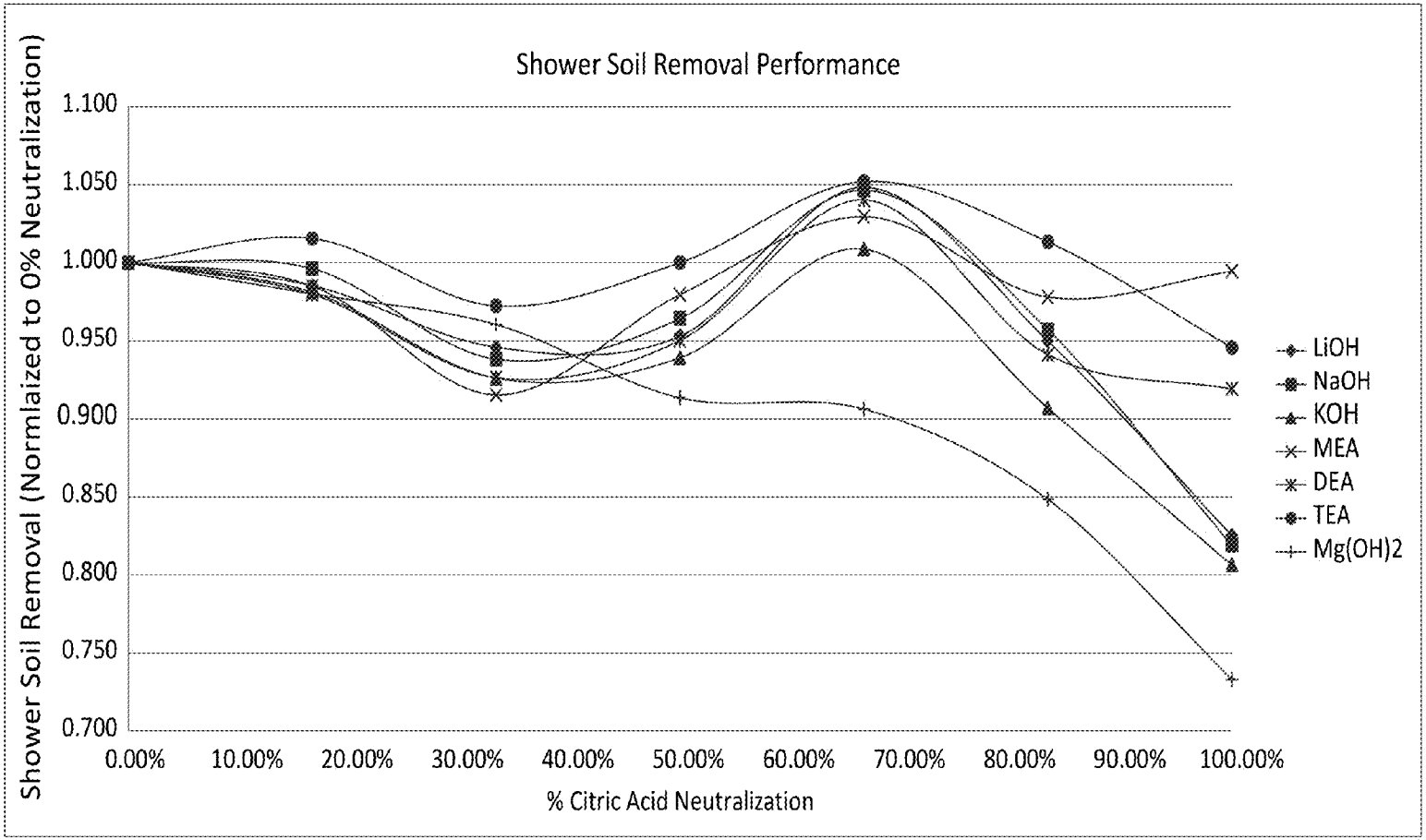
FIG. 2 shows a graph of soil removal performance, normalized to 0% neutralization, using various citric acid salts showing peak performance between about 60% to about 70% neutralization according to embodiments of the invention.
Figure 3:
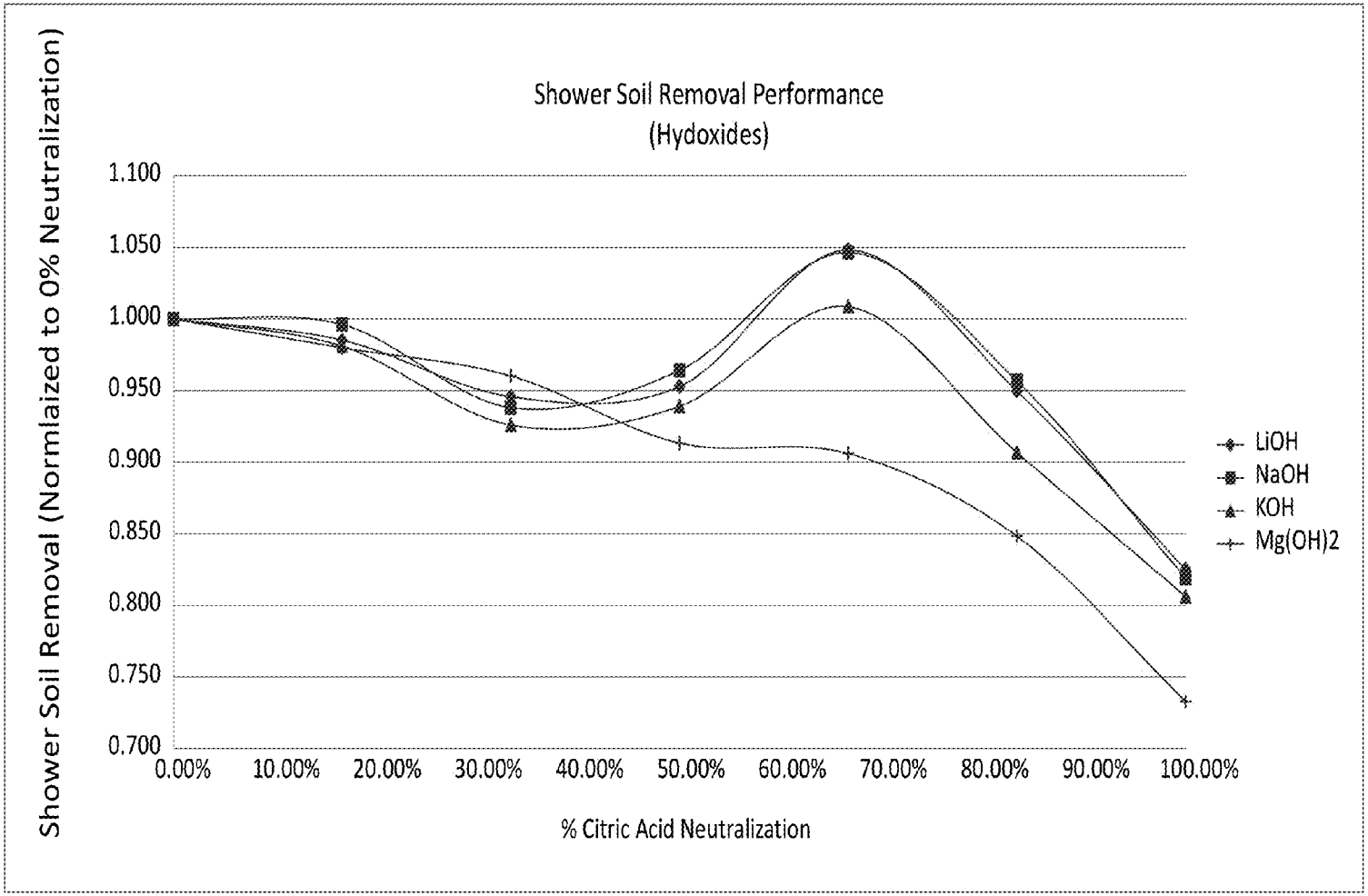
FIG. 3 shows a graph of soil removal performance, normalized to 0% neutralization, using citric acid salts according to embodiments of the invention.
Figure 4:
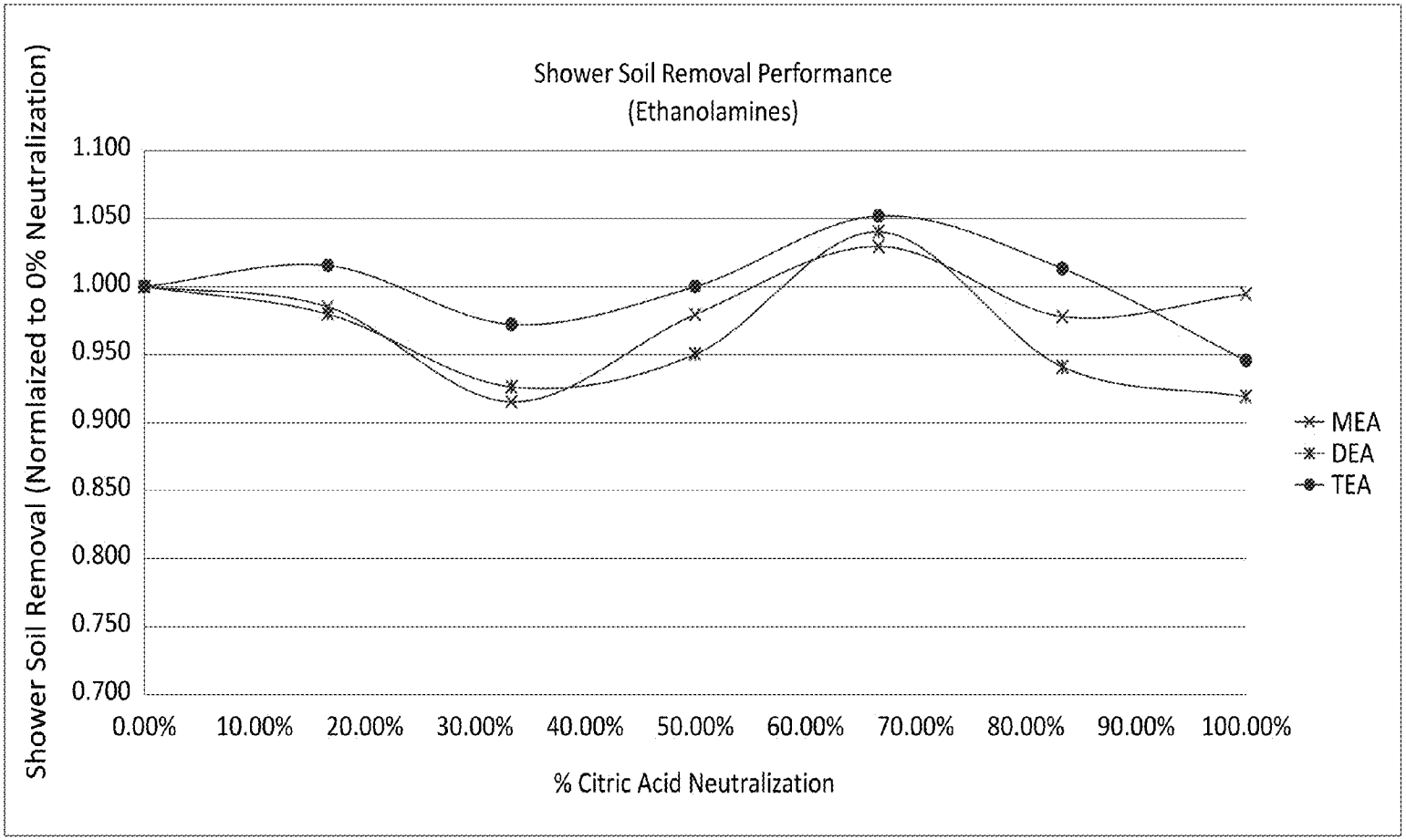
FIG. 4 shows a graph of soil removal performance, normalized to 0% neutralization, using citric acid salts, namely ethanolamine citrate salts, according to embodiments of the invention.

FIG. 2 shows the soil removal using the various hydroxide alkalinity sources and ethanolamine alkalinity sources according to the invention, as normalized for 0% neutralization of citric acid to provide partially neutralized citric acid salts. For this figure the control was set to the citric acid only control (i.e. no neutralization or alkalinity source) as shown in Tables 3-9. As consistent with FIG. 1 data, the benefit of the hydroxide alkalinity source is limited to the use of the monovalent hydroxides. Again, soil removal performance can be summarized as having increased performance over the control (unneutralized citric acid) at about ⅔ neutralization. The decrease in performance over the control was exhibited at about ⅓ neutralized state and again for the majority of citric acid salts at above 90% neutralization. FIGS. 3-4 show the results of FIG. 2 separated into different graphs by use of either the hydroxide alkalinity sources (FIG. 3) or the ethanolamine alkalinity sources (FIG. 4).

The results indicate that while citric acid (unneutralized) and sodium citrate (or other fully neutralized salts) have been used extensively in bathroom cleaners, increased soil removal efficacy is provided by the compositions and methods of the invention employing partially neutralized citric acid salts. It is unexpected that the range of approximately ⅔ neutralized citric acid salts provide superior cleaning over citric acid as the composition has a milder acidic pH which would not be expected to provide substantially similar and/or superior cleaning results.

In addition, the results indicate that the neutralizing agent (i.e. alkalinity source) used to provide the in-situ neutralization plays a large role in the performance of the bathroom cleaner composition. In some embodiments, the use of a monoethanolamine alkalinity source for the neutralizing agent provides fully neutralized citrate salts having at least substantially similar cleaning performance to controls (i.e. unneutralized citric acid). This was not demonstrated by the citric acid salts generated from the monovalent hydroxide neutralizing agents and provides further unexpected efficacy of the compositions and methods of the invention suitable for use as cleaning compositions having neutral pH (about 7) that is capable of outperforming monovalent citrates at the same neutral pHs.

Example 2

The formulas employed in Example 1 were further analyzed, as shown in Table 10, to determine the percentage neutralization, as shown here for the citric acid salt (sodium citrate salt) compositions using the sodium hydroxide alkalinity source. The calculations shown in Table 10 are theoretical based on estimations using the Henderson-Hasselbalch equation and the pKa values for each carboxyl group of citric acid; respectively, 3.15, 4.77, and 6.40.

TABLE 10

| | Conc | Use | Carbox- | Concentrate | | Use | |
|---|---|---|---|---|---|---|---|
| Formula | pH | pH | yl | Acid | Ion | Acid | Ion |
| Citric | 1.76 | 2.43 | 1 | 96.09% | 3.91% | 84.00% | 16.00% |
| Only | 1.76 | 2.43 | 2 | 99.90% | 0.10% | 99.54% | 0.46% |
| | 1.76 | 2.43 | 3 | 100.00% | 0.00% | 99.99% | 0.01% |
| Na 1 | 2.92 | 3.15 | 1 | 62.94% | 37.06% | 50.00% | 50.00% |
| | 2.92 | 3.15 | 2 | 98.61% | 1.39% | 97.66% | 2.34% |
| | 2.92 | 3.15 | 3 | 99.97% | 0.03% | 99.94% | 0.06% |
| Na 2 | 3.56 | 3.84 | 1 | 28.01% | 71.99% | 16.96% | 83.04% |
| | 3.56 | 3.84 | 2 | 94.19% | 5.81% | 89.49% | 10.51% |
| | 3.56 | 3.84 | 3 | 99.86% | 0.14% | 99.73% | 0.27% |

TABLE 10-continued

| | Conc | Use | Carbox- | Concentrate | | Use | |
|---|---|---|---|---|---|---|---|
| Formula | pH | pH | yl | Acid | Ion | Acid | Ion |
| Na 3 | 4.13 | 4.49 | 1 | 9.48% | 90.52% | 4.37% | 95.63% |
| | 4.13 | 4.49 | 2 | 81.36% | 18.64% | 65.58% | 34.42% |
| | 4.13 | 4.49 | 3 | 99.47% | 0.53% | 98.78% | 1.22% |
| Na 4 | 4.69 | 5.17 | 1 | 2.80% | 97.20% | 0.95% | 99.05% |
| | 4.69 | 5.17 | 2 | 54.59% | 45.41% | 28.47% | 71.53% |
| | 4.69 | 5.17 | 3 | 98.09% | 1.91% | 94.44% | 5.56% |
| Na 5 | 5.22 | 5.79 | 1 | 0.84% | 99.16% | 0.23% | 99.77% |
| | 5.22 | 5.79 | 2 | 26.19% | 73.81% | 8.72% | 91.28% |
| | 5.22 | 5.79 | 3 | 93.80% | 6.20% | 80.29% | 19.71% |
| Na 6 | 6.44 | 6.95 | 1 | 0.05% | 99.95% | 0.02% | 99.98% |
| | 6.44 | 6.95 | 2 | 2.09% | 97.91% | 0.66% | 99.34% |
| | 6.44 | 6.95 | 3 | 47.70% | 52.30% | 21.99% | 78.01% |

The percentage of each constituent on each carboxyl group over the pH range in which the tests of Example 1 were conducted are shown in Table 10. For example, in the preferred pH range of about 5 to about 5.5 in the use solution, carboxyl 1 is almost 100% neutralized, carboxyl 2 is about 80% neutralized, and carboxyl 3 is about 10% neutralized, support the overall degree of neutralization of the molecule being about "⅔ neutralized" or "67% neutralized" in that carboxyls 1 and 2 are almost fully neutralized, while carboxyl 3 is still primarily in the acid form.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A cleaning composition comprising:

from about 0.5 wt-% to about 65 wt-% of a partially neutralized citric acid salt, and a surfactant selected from the group consisting of a low foaming surfactant, high foaming surfactant, zwitterionic surfactant, nonionic surfactant, and combination thereof;

wherein said partially neutralized citric acid salt is between about 56-76% neutralized, the composition as a concentrate and/or a use solution has a pH between about 5-6, said citric acid salt is a monovalent hydroxide citrate or an ethanolamine citrate, and wherein said composition provides at least substantially-similar cleaning performance as citric acid and/or sodium citrate.

2. The composition of claim 1, wherein said monovalent hydroxide citrate is selected from the group consisting of sodium hydroxide citrate, potassium hydroxide citrate, lithium hydroxide citrate and combinations thereof, and wherein said ethanolamine citrate is selected from the group consisting of monoethanolamine citrate, diethanolamine citrate, triethanolamine citrate, and a combination thereof.

3. The composition of claim 1, wherein the surfactant is a $C_8$-$C_{16}$ alkyl polyglycoside surfactant, alkylphenoxypolyethoxyalkanol surfactant, or betaine surfactant.

4. The composition of claim 1, wherein the surfactant is cocoamido propyl betaine.

5. The composition of claim 1 further comprising an additional functional ingredient selected from the group consisting of preservatives, fragrances, dyes, biocides, antimicrobials, solvents, additional surfactants, and combinations thereof.

6. The composition of claim 1, wherein the surfactant is a low foaming surfactant.

7. A cleaning composition comprising:

from about 0.5 wt-% to about 65 wt-% of citric acid;

from about 1 wt-% to about 50 wt-% of a surfactant selected from the group consisting of a low foaming surfactant, high foaming surfactant, zwitterionic surfactant, nonionic surfactant, and combination thereof, and from about 1 wt-% to about 25 wt-% of an alkalinity source neutralizing agent, wherein said neutralizing agent is selected from the group consisting of sodium hydroxide, potassium hydroxide, lithium hydroxide, monoethanolamine, diethanolamine, triethanolamine, and a combination thereof;

wherein said composition generates in-situ a partially neutralized citric acid salt having a degree of neutralization of between about 56% to about 76%; and further wherein the composition as a concentrate and/or a use solution has a pH between about 5-6.

8. The composition of claim 7, wherein the surfactant is a $C_8$-$C_{16}$ alkyl polyglycoside surfactant, alkylphenoxypolyethoxyalkanol surfactant, or betaine surfactant.

9. The composition of claim 7 further comprising an additional functional ingredient selected from the group consisting of preservatives, fragrances, dyes, biocides, antimicrobials, solvents, additional surfactants, and combinations thereof.

10. The composition of claim 7, wherein the surfactant is a low-foaming surfactant.

11. The composition of claim 7 wherein said composition provides at least substantially-similar cleaning performance as citric acid and/or sodium citrate.

12. A method for cleaning bathroom surfaces and/or other hard surfaces comprising:

contacting a soiled surface for a period of time sufficient to remove hard water soils and/or soap scum stains with an aqueous composition having a pH between about 5-6 and comprising from about 0.5 wt-% to about 65 wt-% of a partially neutralized citric acid salt, wherein said partially neutralized citric acid salt is a monovalent hydroxide citrate or an ethanolamine citrate, and has a degree of neutralization of between about 56-76% and a surfactant selected from the group consisting of a low foaming surfactant, high foaming surfactant, zwitterionic surfactant, nonionic surfactant, and combination thereof; and removing said soils from said surface, wherein said composition provides at least substantially-similar cleaning performance as citric acid and/or sodium citrate.

13. The method of claim 12 wherein said contacting is for a period of at least a few seconds to a few minutes.

14. The method of claim 12 further comprising a rinse step and/or use of mechanical force in said removal step.

15. The method of claim 12 wherein said partially neutralized citric acid salt is a monovalent hydroxide citrate selected from the group consisting of sodium hydroxide citrate, potassium hydroxide citrate, lithium hydroxide citrate, and combinations thereof.

16. The method of claim 12, wherein the surfactant is a $C_8$-$C_{16}$ alkyl polyglycoside surfactant, alkylphenoxypolyethoxyalkanol surfactant, or betaine surfactant.

17. The method of claim 12 further comprising a step of diluting the aqueous composition in a range of from about 1 to about 16 ounces of said aqueous composition to about 1 gallon of a water diluent.

* * * * *